US009594328B2

(12) United States Patent
Aratachi et al.

(10) Patent No.: US 9,594,328 B2
(45) Date of Patent: Mar. 14, 2017

(54) IMAGE FORMING APPARATUS HAVING CARTRIDGE DETACHABLY MOUNTED THEREIN

(71) Applicant: Brother Kogyo Kabushiki Kaisha, Nagoya-shi, Aichi-ken (JP)

(72) Inventors: Tomitake Aratachi, Toyokawa (JP); Satoru Ishikawa, Kitanagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/748,945

(22) Filed: Jun. 24, 2015

(65) Prior Publication Data

US 2015/0293472 A1 Oct. 15, 2015

Related U.S. Application Data

(63) Continuation of application No. 14/228,287, filed on Mar. 28, 2014, now Pat. No. 9,092,006.

(30) Foreign Application Priority Data

Mar. 28, 2013 (JP) ..... 2013-069815

(51) Int. Cl.
*G03G 15/00* (2006.01)
*G03G 15/08* (2006.01)
(Continued)

(52) U.S. Cl.
CPC ..... *G03G 15/0863* (2013.01); *G03G 21/1647* (2013.01); *G03G 21/1676* (2013.01); *G03G 21/1857* (2013.01); *G03G 2221/163* (2013.01)

(58) Field of Classification Search
CPC ..... G03G 21/1647; G03G 21/1676; G03G 21/1857; G03G 21/1867; G03G 21/1871;
(Continued)

(56) References Cited

U.S. PATENT DOCUMENTS 8,463,145 B2 6/2013 Ukai et al.
9,092,006 B2 * 7/2015 Aratachi ..... G03G 21/1676
(Continued)

FOREIGN PATENT DOCUMENTS

EP 2378378 A2 10/2011
JP 2006-267994 A 10/2006
JP 2011-215374 A 10/2011

*Primary Examiner* — Ryan Walsh
(74) *Attorney, Agent, or Firm* — Banner & Witcoff, Ltd.

(57) ABSTRACT

In an image forming apparatus, a sensing body is disposed at a first position when a cartridge has been removed from an apparatus body, is disposed at a second position when a first part of the sensing body contacts a housing of the cartridge that has been mounted in the apparatus body, and is disposed at a third position when a second part of the sensing body contacts a movable member of the cartridge that has been mounted in the apparatus body. A judging unit determines that the cartridge has been removed from the apparatus body if the sensing body is at the first position, determines that the cartridge has been mounted in the apparatus body if the sensing body is at the second position, and determines that the cartridge is a new product if the sensing body is at the third position.

13 Claims, 16 Drawing Sheets

(51) Int. Cl.
*G03G 21/16* (2006.01)
*G03G 21/18* (2006.01)

(58) Field of Classification Search
CPC ..... G03G 2221/163; G03G 2221/166; G03G 2221/18
See application file for complete search history.

(56) References Cited

U.S. PATENT DOCUMENTS

| | | | |
|---|---|---|---|
| 2006/0193646 | A1 | 8/2006 | Suzuki et al. |
| 2011/0243578 | A1 | 10/2011 | Ukai et al. |
| 2013/0051814 | A1 | 2/2013 | Itabashi et al. |
| 2013/0272724 | A1 | 10/2013 | Ukai et al. |

* cited by examiner

IMAGE FORMING APPARATUS HAVING CARTRIDGE DETACHABLY MOUNTED THEREIN

CROSS REFERENCE TO RELATED APPLICATION

This application is a continuation of U.S. patent application Ser. No. 14/228,287 filed Mar. 28, 2014 which claims priority from Japanese Patent Application No. 2013-069815 filed Mar. 28, 2013. The entire content of this priority application is incorporated herein by reference.

TECHNICAL FIELD

The present invention relates to an image forming apparatus employing an electrophotographic system.

BACKGROUND

As a printer of the electrophotographic type, there is known a printer that is provided with a photosensitive body and a developer cartridge. The developer cartridge is configured to supply toner to the photosensitive body.

This type of printer is provided with a new product detecting unit used for judging information on the developer cartridge mounted in the printer. Examples of the information include information on whether the developer cartridge is a new (unused) product.

For example, there has been proposed such a laser printer, in which an actuator is provided inside a main casing of the printer. A detection gear is rotatably supported on the developer cartridge. The detection gear is provided with a contact projection for contacting the actuator. When the developer cartridge is mounted in the main casing, the detection gear is driven to rotate, as a result of which the contact projection on the detection gear contacts the actuator and pivots the actuator. The movement of the actuator is detected by an optical sensor. Detection results by the optical sensor are used to judge the information on the developer cartridge.

SUMMARY

It is desirable that an image forming apparatus can detect not only whether the developer cartridge is a new product but also whether a developer cartridge has been mounted in the main casing.

In view of this, it is conceivable to modify the conventional image forming apparatus described above such that the image forming apparatus has not only the sensor for detecting whether the developer cartridge is a new product but also an additional sensor for detecting whether a developer cartridge has been mounted in the main casing. This conceivable modification, however, will increase the production cost of the image forming apparatus.

It is also conceivable to modify the conventional image forming apparatus such that the detection gear, which is used for detecting whether the developer cartridge is a new product, is used also for detecting whether a developer cartridge has been mounted in the main casing.

The detection gear is rotatable relative to a housing of the developer cartridge. So, the detection gear may possibly have a relatively large amount of play with respect to the housing. Due to this large amount of play, the detection gear may possibly fail to contact the actuator while the detection gear is not rotating, and therefore make a detection error in detecting whether a developer cartridge has been mounted in the main casing.

An object of the present invention is to provide an improved image forming apparatus that can detect whether a cartridge is mounted in an apparatus body of the image forming apparatus as well as can detect whether the cartridge is a new product.

In order to attain the above and other objects, the invention provides an image forming apparatus including: an apparatus body; and a cartridge configured to be mounted in and removed from the apparatus body. The cartridge includes: a housing; and a movable member configured to move relative to the housing upon receipt of input of a drive force from the apparatus body. The apparatus body includes: a sensing body having a first part configured to contact the housing and having a second part configured to contact the movable member; and a judging unit configured to judge whether the cartridge is a new product or a used product. The movable member has a contact part configured to contact the second part of the sensing body. The sensing body is configured to move among first through third positions, the sensing body being configured to be disposed at the first position when the cartridge has been removed from the apparatus body, to be disposed at the second position when the first part of the sensing body contacts the housing of the cartridge that has been mounted in the apparatus body, and to be disposed at the third position when the second part of the sensing body contacts the movable member of the cartridge that has been mounted in the apparatus body. The judging unit is configured to determine that the cartridge has been removed from the apparatus body if the sensing body is at the first position, to determine that the cartridge has been mounted in the apparatus body if the sensing body is at the second position, and to determine that the cartridge is a new product if the sensing body is at the third position.

According to another aspect, the invention provides an image forming apparatus including: an apparatus body; and a developer cartridge configured to be mounted in and removed from the apparatus body. The developer cartridge includes: a housing; a rotational body; a rotation-associating moving member; and a developing roller. The rotational body is configured to rotate about a prescribed rotational axis upon receipt of input of drive force from the apparatus body, the prescribed rotational axis extending in a prescribed direction. The rotation-associating moving member is configured to move relative to the housing in association with rotation of the rotational body. The developing roller is configured to rotate about a rotational axis that extends along the prescribed rotational axis. The apparatus body includes a sensing body. The sensing body has a first part configured to contact the housing and a second part configured to contact the rotation-associating moving member. The sensing body is configured to rotate about a rotational axis that extends along the prescribed rotational axis when the developer cartridge is mounted in the apparatus body. The housing includes a side wall, the prescribed rotational axis being orthogonal to the side wall. When the developer cartridge is mounted in the apparatus body, a distance between the side wall and the first part in the prescribed direction is shorter than a distance between the side wall and the second part in the prescribed direction.

According to still another aspect, the invention provides a developer cartridge including: a developing roller; a housing; a coupling member; and a detection body. The developing roller is configured to rotate about a first axis, the first axis extending in a first axial direction. The housing is configured to accommodate developer therein. The housing has a side wall. The first axis is orthogonal to the side wall. The housing has a first contact part configured to contact an external detecting device so as to be detected by the external detecting device. The side wall has the first contact part. The coupling member is disposed on the side wall and configured to rotate about an axis that extends along the first axis. The coupling member is configured to receive drive force from outside of the developer cartridge. The detection body is disposed on the side wall and configured to rotate about a second axis that extends along the first axis. The second axis extends in a second axial direction. The detection body has a second contact part that is configured to contact the external detecting device so as to be detected by the external detecting device. The second contact part is configured so as to move by drive force received by the coupling member from a first position to a second position in the second axial direction. The first distance is defined as a distance in the second axial direction from the side wall to the second contact part disposed in the first position. The second distance is defined as a distance in the second axial direction from the side wall to the second contact part disposed in the second position. The second distance is greater than the first distance. The second contact part is configured to contact the detecting device when the second contact part is in the second position. The second distance is longer than a distance between the side wall and the first contact part in the first axial direction.

BRIEF DESCRIPTION OF THE DRAWINGS

The particular features and advantages of the invention as well as other objects will become apparent from the following description taken in connection with the accompanying drawings, in which:

FIGS. 5A and 5B illustrate a pivoting state of an actuator when the developer cartridge has been removed from a main casing of the printer, wherein FIG. 5A is a left side view and FIG. 5B is a perspective view seen from a rear left side;

FIGS. 6A and 6B illustrate a pivoting state of the actuator when the developer cartridge is mounted in the main casing of the printer, wherein FIG. 6A is a left side view and FIG. 6B is a perspective view seen from a rear left side;

FIGS. 9A and 9B illustrate a pivoting state of the actuator when a contact part of the sensor gear contacts the actuator, wherein FIG. 9A is a left side view and FIG. 9B is a perspective view seen from a rear left side;

FIGS. 12A and 12B illustrate a pivoting state of an actuator according to a second embodiment when a developer cartridge has been removed from a main casing of a printer, wherein FIG. 12A is a left side view of the actuator and FIG. 12B is a perspective view of the actuator as seen from a front left side thereof;

FIGS. 13A and 13B illustrate a pivoting state of the actuator according to the second embodiment when the developer cartridge is mounted in the main casing of the printer, wherein FIG. 13A is a left side view and FIG. 13B is a perspective view seen from a front left side;

FIGS. 14A and 14B illustrate a pivoting state of the actuator according to the second embodiment when a protrusion of the sensor gear that is disposed on a rear side contacts a second sensing body of the actuator, wherein FIG. 14A is a left side view and FIG. 14B is a perspective view seen from a front left side;

DETAILED DESCRIPTION

Figure 1:
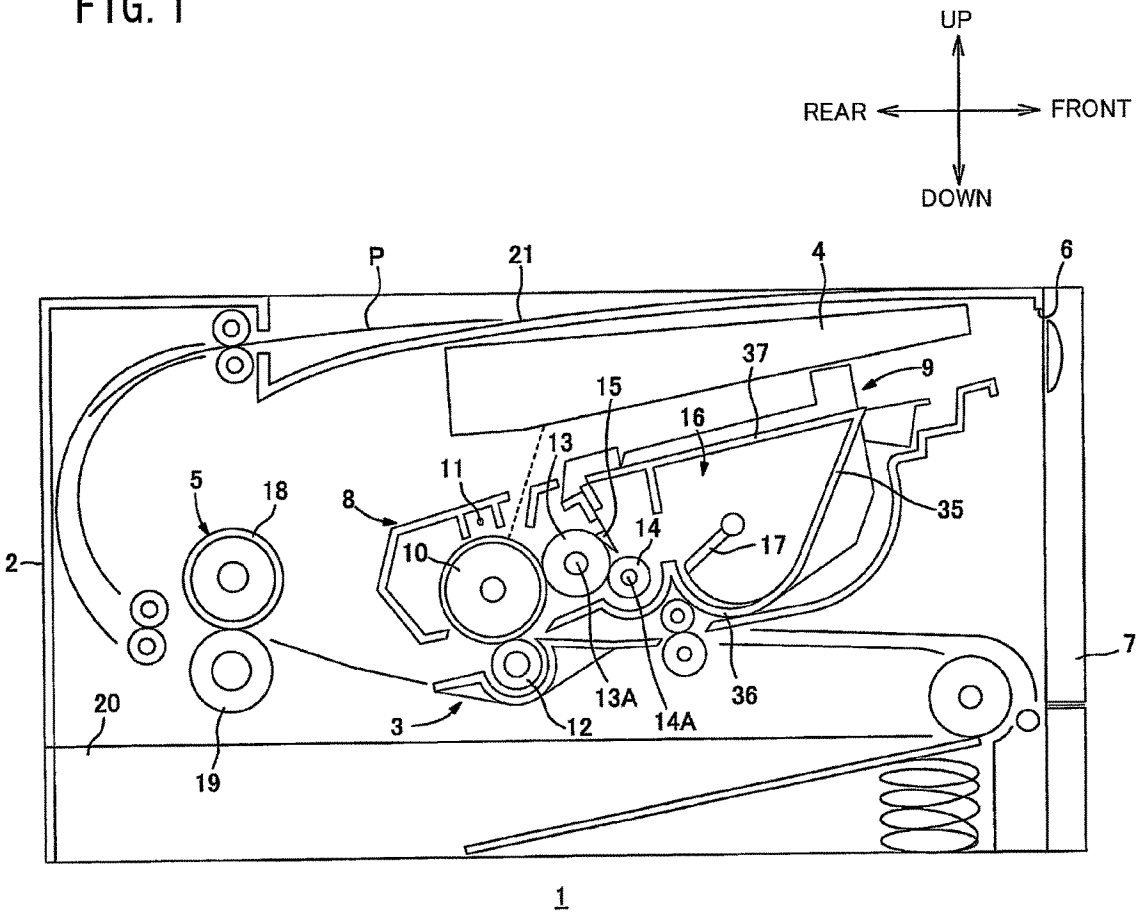
FIG. 1 is a side sectional view of a printer, according to a first embodiment of the present invention, which is taken along a line that extends in a front-rear direction and passes through a right-left center of the printer.

An image forming apparatus according to embodiments of the invention will be described while referring to the accompanying drawings wherein like parts and components are designated by the same reference numerals to avoid duplicating description.

1. Entire Configuration of Printer

As shown in FIG. 1, a printer 1 (as an example of an image forming apparatus) is a monochromatic printer of an electrophotographic type.

Directions used in the following description in relation to the printer 1 will reference the state of the printer 1 when the printer 1 is resting on a level surface. More specifically, the side of the printer 1 on which a sheet discharge tray 21 to be described later is provided (the upper side in FIG. 1) will be referred to as the "upper side," and the opposite side (the lower side in FIG. 1) as the "lower side," as indicated by the arrows in FIG. 1. The side of the printer 1 on which a front cover 7 to be described later is provided (the right side in FIG. 1) will be referred to as the "front side," and the opposite side (the left side in FIG. 1) as the "rear side," as also indicated by the arrows in FIG. 1. Further, left and right sides of the printer 1 in the following description will be based on the perspective of the user facing the front side of the printer 1. Thus, the near side of the printer 1 in FIG. 1 will be considered the "left side," and the far side will be considered the "right side." The left-right direction is an example of a first direction, and the vertical direction (up-down direction) is an example of a second direction. A direction directed from the front side to the rear side is an example of a mounting direction. The front side is an example of an upstream side in the mounting direction, and the rear side is an example of a downstream side in the mounting direction.

The printer 1 has: a main casing 2 (as an example of an apparatus body); a process cartridge 3; a scanning unit 4; and a fixing unit 5.

The main casing 2 has a general box shape. The main casing 2 has an opening 6, the front cover 7, a sheet supply tray 20, and the sheet discharge tray 21.

The opening 6 penetrates a front wall of the main casing 2 so as to allow the process cartridge 3 to pass therethrough.

The front cover 7 has a general plate shape. The front cover 7 is supported by the front wall of the main casing 2 so as to be pivotable relative to the main casing 2 about a lower edge of the front cover 7. The front cover 7 is configured to open or close the opening 6.

The sheet supply tray 20 is disposed on a bottom portion of the main casing 2. The sheet supply tray 20 is configured to accommodate sheets of paper P therein.

The sheet discharge tray 21 is disposed on a top surface of the main casing 2.

The process cartridge 3 is configured to be mounted in and removed from the main casing 2. The process cartridge 3 includes a drum cartridge 8 and a developer cartridge 9 (as an example of a cartridge).

The drum cartridge 8 is provided with a photosensitive drum 10, a Scorotron charger 11, and a transfer roller 12.

The photosensitive drum 10 is disposed in the rear end portion of the process cartridge 3. The photosensitive drum 10 is rotatably supported by the drum cartridge 8. The photosensitive drum 10 has a general cylindrical shape that is elongated in the left-right direction.

The Scorotron charger 11 is disposed apart from the upper rear side of the photosensitive drum 10.

The transfer roller 12 is disposed below he photosensitive drum 10, and is in contact with a lower edge of the photosensitive drum 10.

The developer cartridge 9 is configured to be attached to and separated from the drum cartridge 8. The developer cartridge 9 has a developing roller 13, a supply roller 14, a layer thickness regulation blade 15, and a toner accommodating portion 16.

The developing roller 13 is disposed in the rear end portion of the developer cartridge 9 and is rotatably supported by the developer cartridge 9. A rear edge of the developing roller 13 is exposed outside the developer cartridge 9 through the rear edge of the developer cartridge 9.

The supply roller 14 is disposed on the lower front side of the developing roller 13, and is rotatably supported by the developer cartridge 9. The supply roller 14 is in contact with the lower front edge of the developing roller 13.

The layer thickness regulation blade 15 is disposed above the developing roller 13. The layer thickness regulation blade 15 has a general plate shape that is elongated in the left-right direction. A lower edge of the layer thickness regulation blade 15 is in contact with a front edge of the developing roller 13.

The toner accommodating portion 16 is disposed on the front side of both the supply roller 14 and the layer thickness regulation blade 15. The toner accommodating portion 16 is configured to accommodate toner therein. An agitator 17 is provided in the toner accommodating portion 16.

The agitator 17 is configured to rotate within the toner accommodating portion 16.

The scanning unit 4 is disposed above the process cartridge 3. The scanning unit 4 emits a laser beam based on image data toward the photosensitive drum 10 as indicated by a broken line in FIG. 1.

The fixing unit 5 is disposed to the rear of the process cartridge 3. The fixing unit 5 has a heat roller 18 and a pressure roller 19 that is pressed against a lower edge of the heat roller 18.

When the printer 1 starts an image forming operation, the Scorotron charger 11 charges the surface of the photosensitive drum 10 uniformly. Afterwards, the scanning unit 4 exposes the surface of the photosensitive drum 10 to a laser beam on the basis of image data. As a result, an electrostatic latent image corresponding to the image data is formed on the surface of the photosensitive drum 10.

The agitator 17 agitates toner in the toner accommodating portion 16, and supplies the toner to the supply roller 14. The supply roller 14 supplies the toner to the developing roller 13. At this time, toner is positively charged through a triboelectric charging process between the developing roller 13 and the supply roller 14, and is borne on the developing roller 13. The layer thickness regulation blade 15 regulates, to a uniform thickness, the thickness of a layer of toner borne on the developing roller 13.

The toner thus borne on the developing roller 13 is supplied onto the electrostatic latent image formed on the surface of the photosensitive drum 10. As a result, a toner image is formed and borne on the surface of the photosensitive drum 10.

Various rollers are rotated to feed the sheets of paper P, one sheet by one sheet at prescribed timings, from the sheet feed tray 20 to a position between the photosensitive drum 10 and the transfer roller 12. The toner image is transferred from the photosensitive drum 10 onto a sheet of paper P when the sheet of paper P passes through between the photosensitive drum 10 and the transfer roller 12.

Afterwards, the sheet of paper P is thermally pressed by the heat roller 18 and the pressure roller 19 when the sheet passes through between the heat roller 18 and the pressure roller 19. At this time, the toner image is thermally fixed onto the sheet of paper P. Thereafter, the sheet of paper P is discharged onto the sheet discharge tray 21.

2. Developer Cartridge

Figure 2:
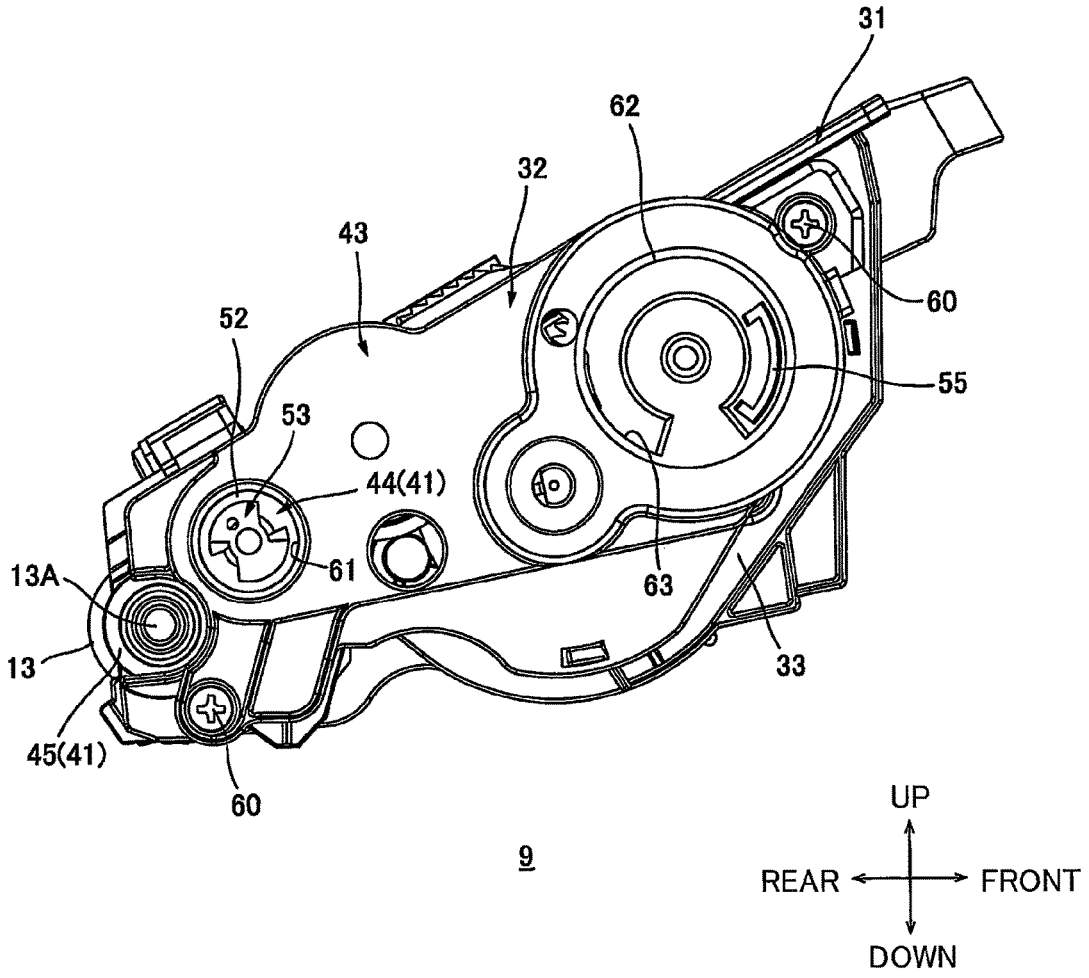
FIG. 2 is a left side view of a developer cartridge shown in FIG. 1.
Figure 3:
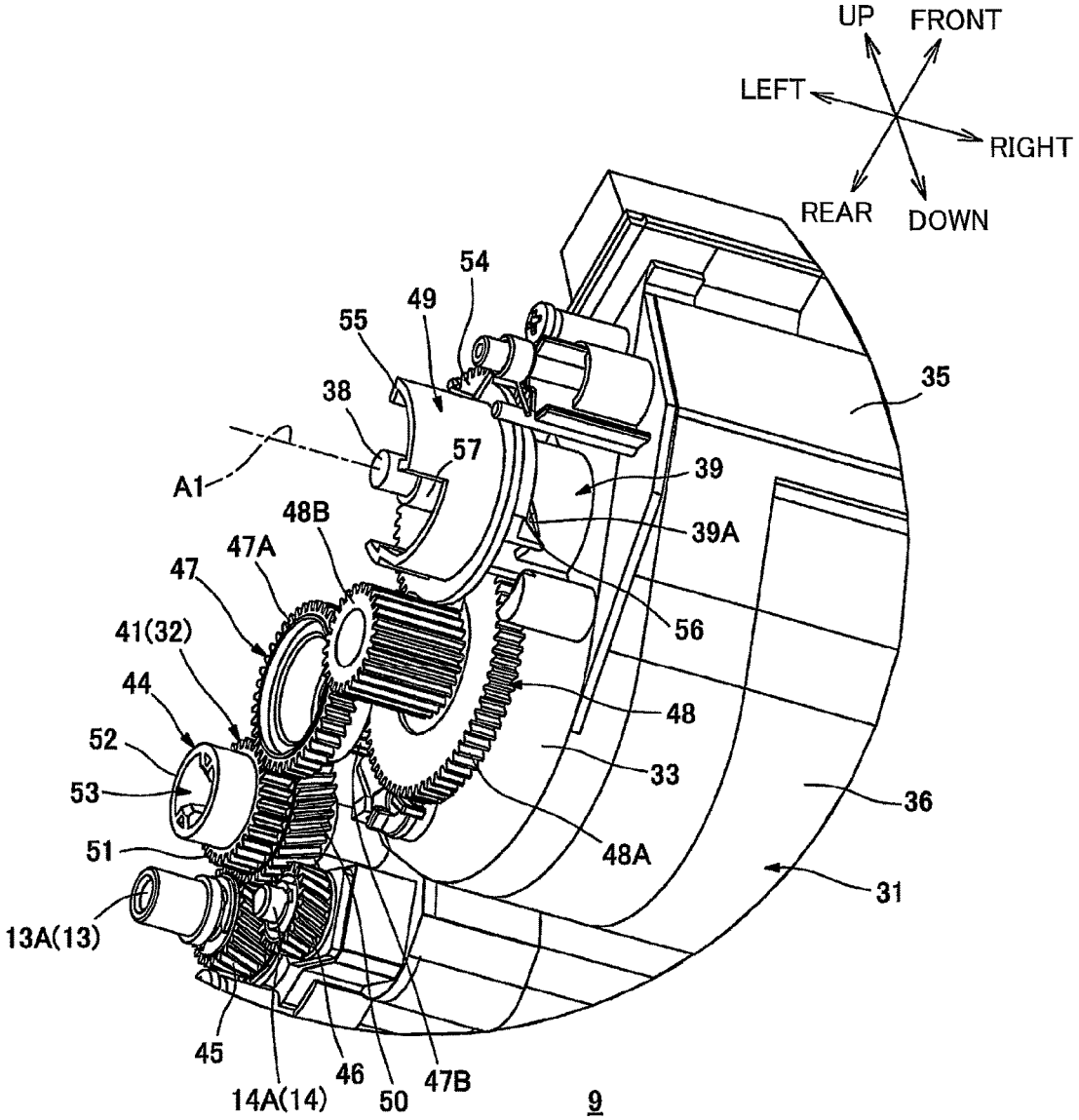
FIG. 3 is a perspective view of the developer cartridge seen from a lower left side thereof, wherein a gear cover has been removed from the developer cartridge.

As shown in FIGS. 2 and 3, the developer cartridge 9 includes a frame 31, and a drive unit 32.

(1) Frame

As shown in FIGS. 1 and 3, the frame 31 has a general box shape with an opening formed in the rear end. The frame 31 is configured of a left wall 33 (as an example of a first wall and an example of a side wall), a right wall 34 (as an example of a second wall), a front wall 35, a bottom wall 36, and a top wall 37.

The left wall 33 constitutes the left side of the frame 31. The left wall 33 has a plate shape that is generally rectangular in a side view and elongated in the front-rear direction. The left wall 33 includes a support shaft 38, and a support part 39 (see FIG. 4).

Figure 4:
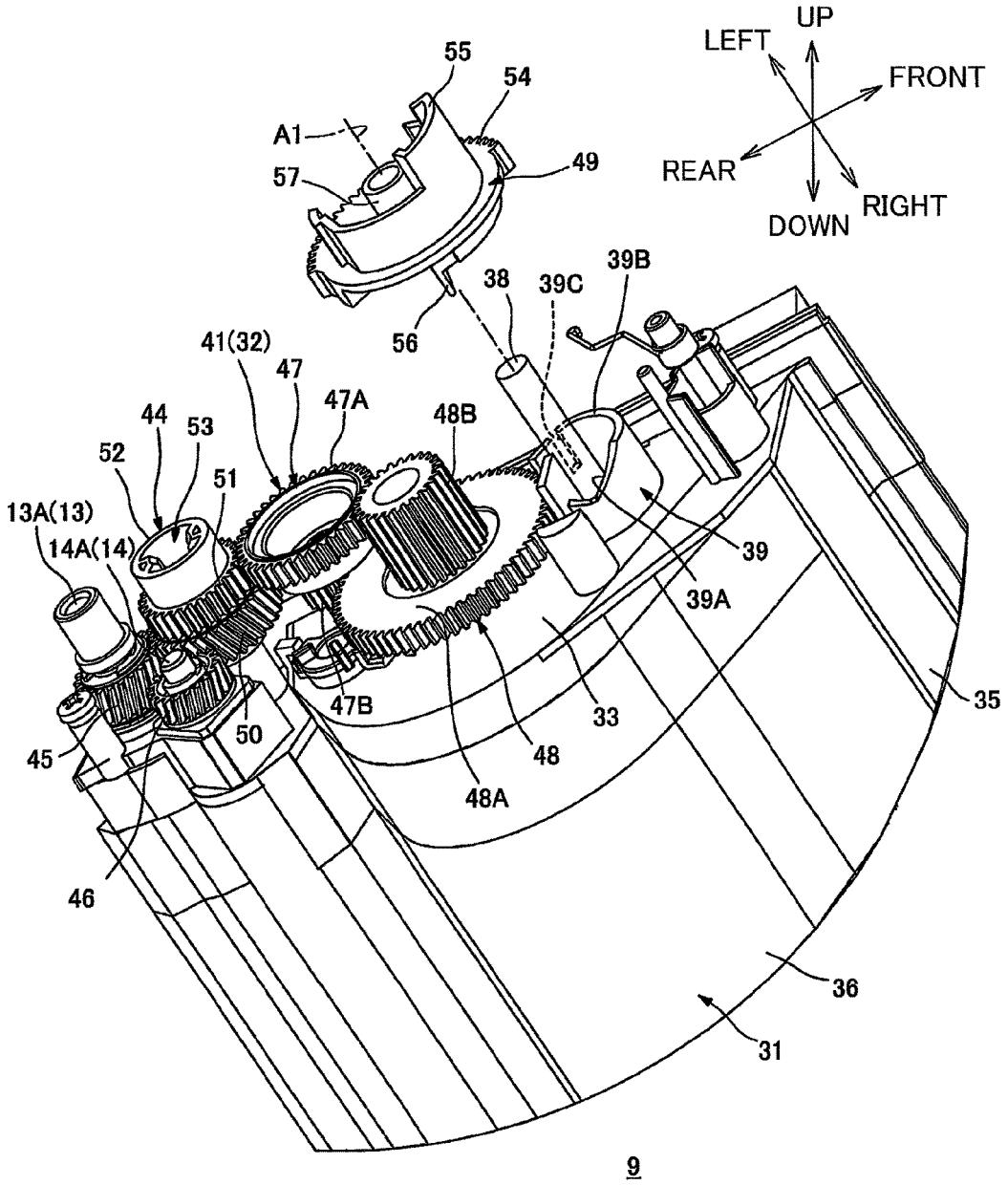
FIG. 4 illustrates how a sensor gear shown in FIG. 3 is attached to the developer cartridge.

As shown in FIG. 4, the support shaft 38 is disposed near the front edge of the left wall 33. The support shaft 38 has a general columnar shape and extends leftward from the left surface of the left wall 33. The support shaft 38 has a center axis A1 (as an example of a first axis).

The support part 39 protrudes leftward from the left surface of the left wall 33. The support part 39 has a general cylindrical shape and is centered on the support shaft 38. The support part 39 includes a sloped surface 39A, a level surface 39B, and a notched part 39C.

The sloped surface 39A is provided on the lower portion of the support part 39 and constitutes the left surface thereof.

In a left side view, the sloped surface 39A slopes leftward toward the downstream side with respect to the counterclockwise direction.

The level surface 39B constitutes part of the left surface of the support part 39 that is formed continuously with the downstream end of the sloped surface 39A in the counterclockwise direction of a left side view. The level surface 39B extends parallel to the left wall 33.

The notched part 39C is formed near the downstream end of the level surface 39B with respect to the counterclockwise direction in a left side view. The notched part 39C is recessed rightward from the level surface 39B.

The right wall 34 constitutes the right side of the frame 31 and, hence, is separated from the left wall 33 in the left-right direction. The right wall 34 has a plate shape that is generally rectangular in a side view and elongated in the front-rear direction.

The front wall 35 bridges the front edges of the left wall 33 and right wall 34. The front wall 35 has a general plate shape that is elongated vertically.

The bottom wall 36 bridges the bottom edges of the left wall 33 and right wall 34. The bottom wall 36 is curved and extends rearward from the bottom edge of the front wall 35. The bottom wall 36 has a general plate shape.

The top wall 37 (see FIGS. 1 and 8) is disposed on top of the top edges of the left wall 33, right wall 34, and front wall 35. The top wall 37 has a general plate shape that is elongated in the left-right direction. The peripheral edges of the top wall 37 are fixed to the top edges of the left wall 33, right wall 34, and front wall 35 through welding or another method.

(2) Drive Unit

As shown in FIGS. 2 and 3, the drive unit 32 includes a gear train 41, and a cover 43 (as an example of a cover member and an example of a gear cover).

(2-1) Gear Train

The gear train 41 includes a development coupling 44 (as an example of a coupling member), a development gear 45, a supply gear 46, an intermediate gear 47, an agitator gear 48, and a sensor gear 49 (as an example of a movable member, an example of a rotational body, and an example of a detection body).

(2-1-1) Development Coupling

The development coupling 44 is rotatably supported on the rear end of the left wall 33. The development coupling 44 has a general columnar shape and is elongated in the left-right direction. The development coupling 44 includes a first gear part 50, a second gear part 51, and a coupling part 52.

The first gear part 50 is disposed on the right end of the development coupling 44. The first gear part 50 has a general disc shape with substantial thickness in the left-right direction. The first gear part 50 includes gear teeth provided around its entire circumference. The gear teeth are angled teeth lying on a left-handed helix.

The second gear part 51 protrudes leftward from the left surface of the first gear part 50. The second gear part 51 has a general disc shape with substantial thickness in the left-right direction. The second gear part 51 is arranged coaxially with the first gear part 50 but has a smaller outer diameter than the first gear part 50. The second gear part 51 has gear teeth provided around its entire circumference. The gear teeth are those of a spur gear that extend in the left right direction along the axis of rotation.

The coupling part 52 protrudes leftward from the left surface of the second gear part 51. The coupling part 52 has a general columnar shape. The coupling part 52 is arranged coaxially with the second gear part 51 but has a smaller outer diameter than the second gear part 51. The coupling part 52 also has a recessed part 53.

The recessed part 53 is a recess that is formed in the left surface of the coupling part 52 so as to be recessed rightwardly. The recessed part 53 has a general elongate hole shape in a side view that is elongated in a radial direction of the coupling part 52.

(2-1-2) Development Gear

The development gear 45 is disposed to the lower rear of the development coupling 44. The development gear 45 has a general disc shape with substantial thickness in the left-right direction. The development gear 45 is supported on the left end of a rotational shaft 13A provided in the developing roller 13 so as to be incapable of rotating relative to the rotational shaft 13A. Gear teeth are formed around the entire circumference of the development gear 45. The gear teeth are angled teeth lying on a right-handed helix. The development gear 45 meshes with the first gear part 50 of the development coupling 44 on the lower rear side thereof.

(2-1-3) Supply Gear

The supply gear 46 is disposed below the development coupling 44. The supply gear 46 has a general disc shape with substantial thickness in the left-right direction. The supply gear 46 is supported on the left end of a rotational shaft 14A provided in the supply roller 14 so as to be incapable of rotating relative to the rotational shaft 14A. Gear teeth are formed around the entire circumference of the supply gear 46. The gear teeth are angled teeth lying on a right-handed helix. The supply gear 46 meshes with the first gear part 50 of the development coupling 44 on the bottom side thereof.

(2-1-4) Intermediate Gear

The intermediate gear 47 is disposed on the front side of the development coupling 44. The intermediate gear 47 is rotatably supported on the left wall 33. The intermediate gear 47 is integrally provided with a large-diameter gear 47A, and a small-diameter gear 47B.

The large-diameter gear 47A has a general disc shape with substantial thickness in the left-right direction. Gear teeth are provided around the entire circumference of the large-diameter gear 47A. The gear teeth are those of a spur gear extending in the left-right direction along its axis of rotation. The large-diameter gear 47A meshes with the second gear part 51 of the development coupling 44 on the front side thereof.

The small-diameter gear 47B protrudes rightward from the right surface of the large-diameter gear 47A. The small-diameter gear 47B has a general columnar shape that is elongated in the left-right direction. The small-diameter gear 47B is arranged coaxially with the large-diameter gear 47A but has a smaller outer diameter than the large-diameter gear 47A. Gear teeth are provided around the entire circumference of the small-diameter gear 47B. The gear teeth are those of a spur gear that extend in the left-right direction along the axis of rotation.

(2-1-5) Agitator Gear

The agitator gear 48 is disposed on the lower front side of the intermediate gear 47. The agitator gear 48 is supported on the left end of a rotational shaft 17A provided in the agitator 17 so as to be incapable of rotating relative to the rotational shaft 17A. The agitator gear 48 is integrally provided with a large-diameter gear 48A, and a small-diameter gear 48B.

The large-diameter gear 48A has a general disc shape with substantial thickness in the left-right direction. Gear teeth are provided around the entire circumference of the large-diameter gear 48A. The gear teeth are those of a spur gear that extend in the left-right direction along the axis of rotation. The large-diameter gear 48A meshes with the small-diameter gear 47B of the intermediate gear 47 on the lower front side thereof.

The small-diameter gear 48B protrudes leftward from the left surface of the large-diameter gear 48A. The small-diameter gear 48B is disposed apart from the lower front side of the large-diameter gear 47A. The small-diameter gear 48B has a general columnar shape that is elongated in the left-right direction. The small-diameter gear 48B is arranged coaxially with the large-diameter gear 48A but has a smaller outer diameter than the large-diameter gear 48A. Gear teeth are provided around the entire circumference of the small-diameter gear 48B. The gear teeth are those of a spur gear that extend in the left-right direction along the axis of rotation.

(2-1-6) Sensor Gear

The sensor gear 49 is disposed on the upper front side of the agitator gear 48. The sensor gear 49 is rotatably supported on the support shaft 38. The sensor gear 49 includes a gear part 54, a contact part 55 (as an example of a contact part, an example of a rotation-associating moving member, and an example of a second contact part), and a sliding part 56.

The gear part 54 has a general disc shape. Gear teeth are formed around half the circumference of the gear part 54. The gear teeth are those of a spur gear that extend along the left-right direction along the axis of rotation. The gear part 54 is configured such that the gear teeth can mesh with the small-diameter gear 48B of the agitator gear 48. The left-right dimension (i.e., thickness) of the gear part 54 is smaller than the left-right dimension of the small-diameter gear 48B. Accordingly, the gear part 54 can remain engaged with the small-diameter gear 48B even while moving in the left-right direction. The gear part 54 includes an insertion part 57.

The insertion part 57 is disposed in the radial center of the gear part 54. The insertion part 57 has a general cylindrical shape that is elongated in the left-right direction. The insertion part 57 penetrates the gear part 54 in the left-right direction. The insertion part 57 receives the left end of the support shaft 38 in a manner that allows the support shaft 38 to rotate and move in the left-right direction relative to the insertion part 57.

The contact part 55 is disposed on the outside of the insertion part 57 in the radial direction of the gear part 54. The contact part 55 protrudes leftward from the left surface of the gear part 54 and extends along the circumferential direction of the gear part 54. The contact part 55 has a general plate shape that is curved.

The sliding part 56 protrudes rightward from the right surface of the gear part 54 and extends along a radial direction of the gear part 54. The sliding part 56 has a general plate shape.

(2-2) Cover

Figure 6A:
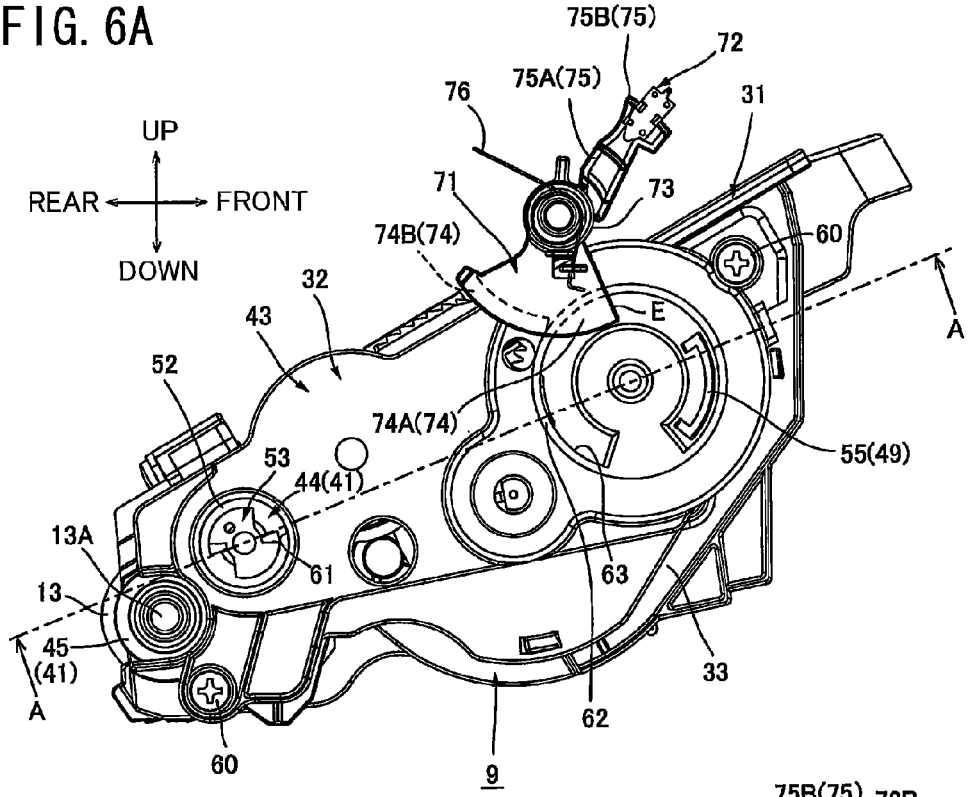
Figure 6B:
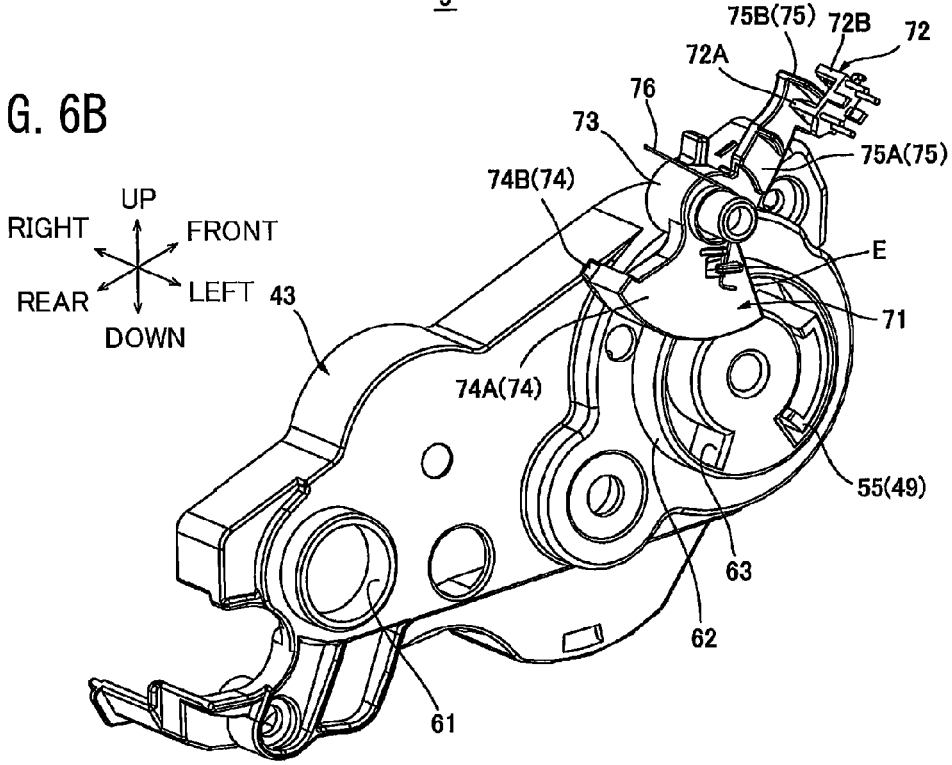

As shown in FIGS. 2, 6A, and 6B, the cover 43 has a general box shape that is open on the right end. The cover 43 is fixed to the left wall 33 of the frame 31 by screws 60. The cover 43 covers the entire gear train 41. Together with the frame 31, the cover 43 configures the housing or case of the developer cartridge 9. The cover 43 has an opening 61, and a protruding part 62 (as an example of a protruding part and an example of a first contact part).

The opening 61 is formed in the rear end of the cover 43 at a position corresponding to the development coupling 44. The opening 61 penetrates the left wall of the cover 43 and exposes the coupling part 52 of the development coupling 44. The opening 61 has a general circular shape in a side view.

The protruding part 62 is disposed on the front end of the cover 43 at a position confronting the sensor gear 49 in the left-right direction. The protruding part 62 has a general cylindrical shape, and protrudes leftward (outward) from the left wall of the cover 43. The cylindrically-shaped protruding part 62 has its protruding end (left end) closed. The protruding part 62 also has an opening 63 which penetrates the left wall (protruding end) of the protruding part 62. The opening 63 exposes the contact part 55 of the sensor gear 49. The opening 63 has a general C-shape in a side view, with the opening of the "C" facing downward.

3. Actuator and Photosensor

Figure 5A:
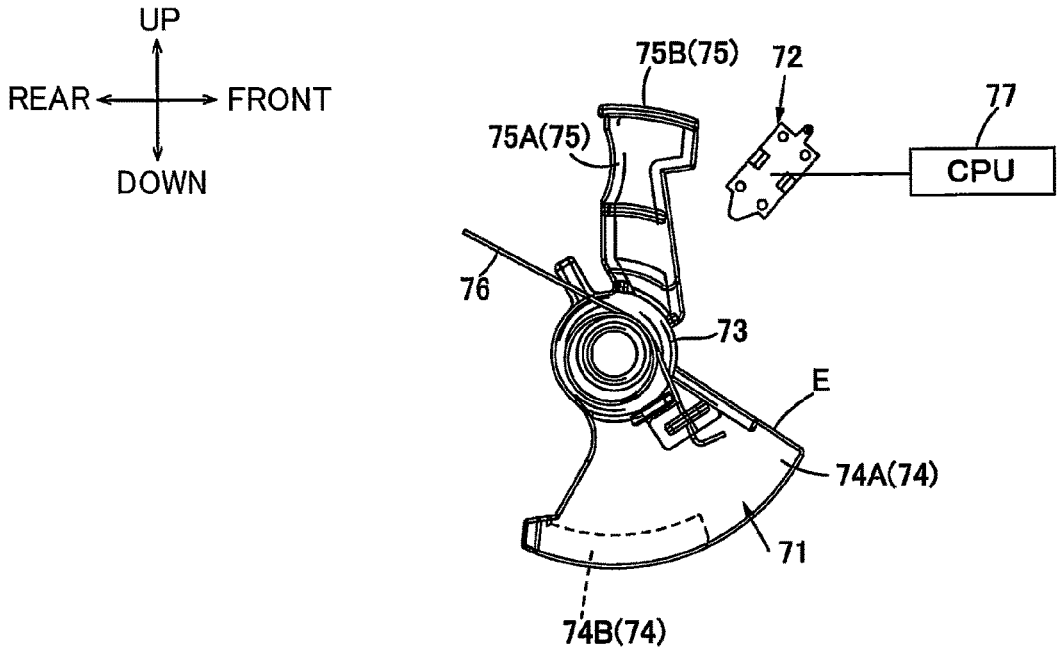
Figure 8:
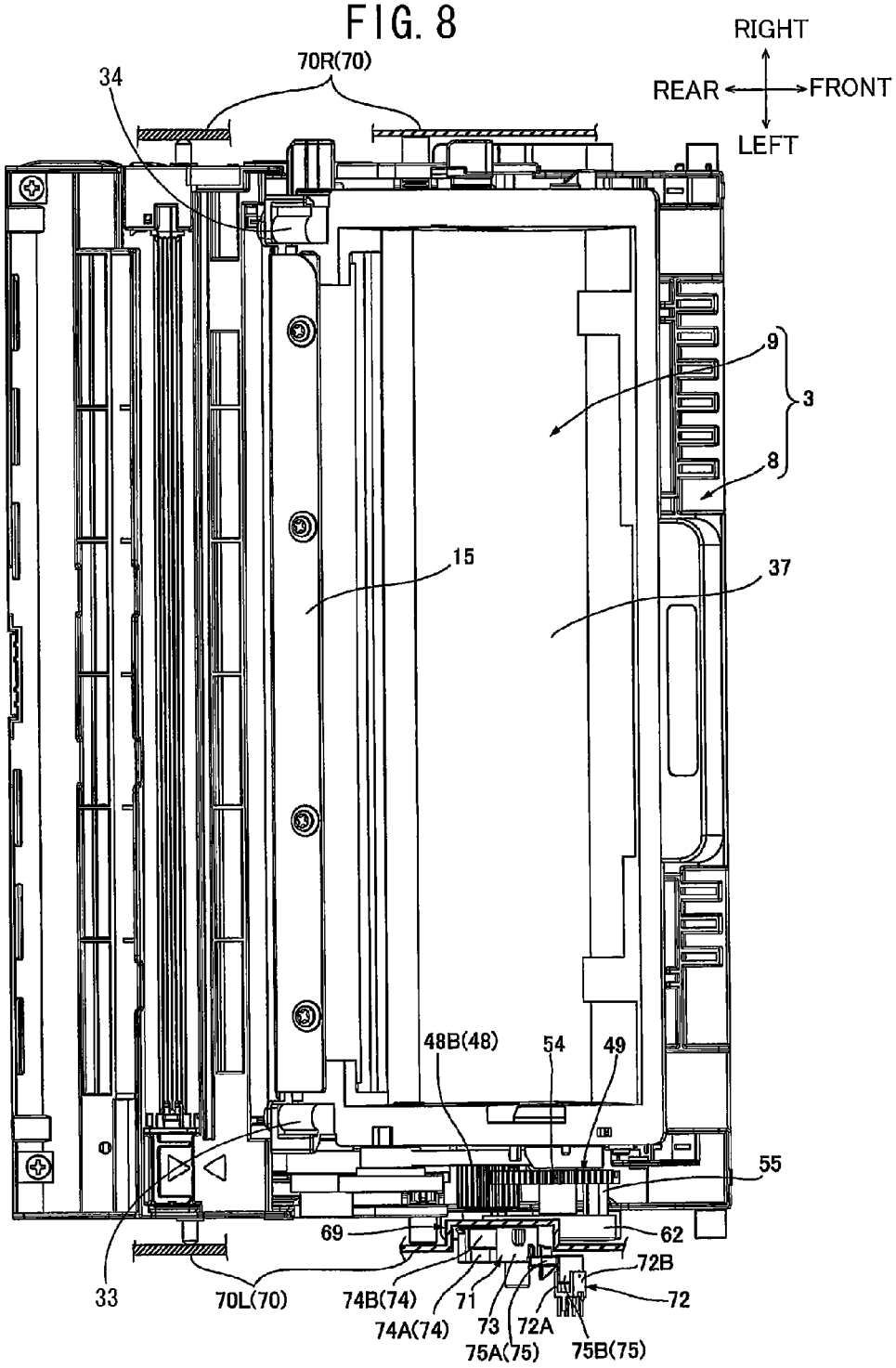
FIG. 8 illustrates how a process cartridge is disposed relative to inner walls of the main casing in the printer.

As shown in FIGS. 5A and 8, the main casing 2 includes a pair of inner walls 70, an actuator 71 (as an example of a sensing body and an example of an external detecting device), a photosensor 72, and a CPU 77 (as an example of a judging unit).

The inner walls 70 are disposed on the inside of the main casing 2 and are apart from each other in the left-right direction. The inner walls 70 are configured to support the respective left and right sides of the process cartridge 3. In the following description, the inner wall 70 disposed on the left side of the main casing 2 will be called the left inner wall 70L, while the inner wall 70 disposed on the right side will be called the right inner wall 70R.

The left inner wall 70L includes a support part 69.

The support part 69 is disposed on the front portion of the left inner wall 70L. The support part 69 has a generally rectangular cross section and protrudes rightward (inward) from the right surface (inner surface) of the left inner wall 70L. The bottom end of the support part 69 is open.

Figure 5B:
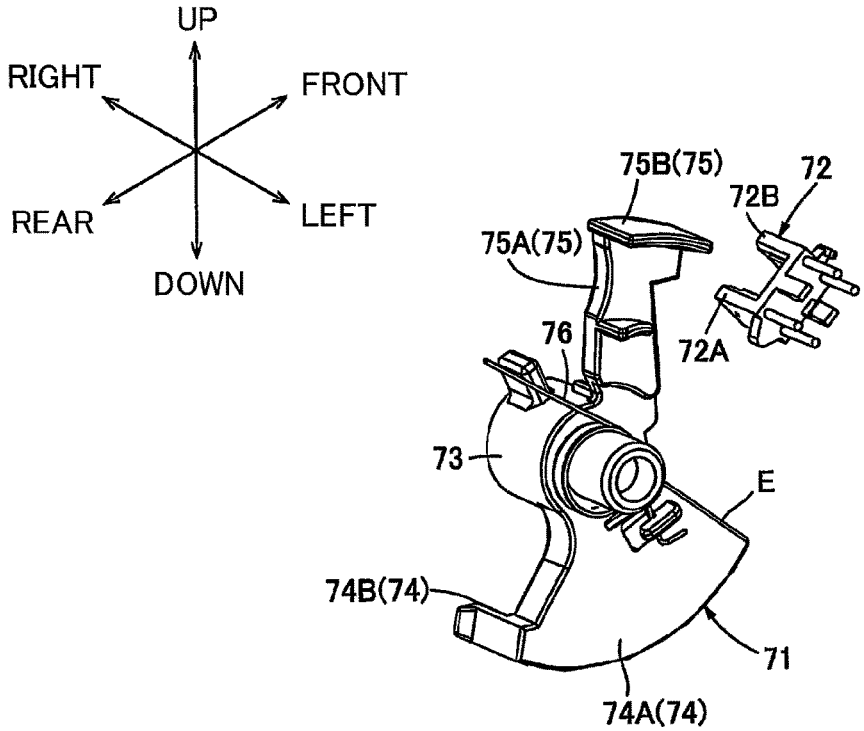

As shown in FIGS. 5A, 5B, and 8, the actuator 71 is disposed to the left of the support part 69. The actuator 71 includes a pivot shaft 73, a contact part 74, a light-shielding part 75, and a wire spring 76. In the following description, directions used with respect to the actuator 71 will be based on the state of the actuator 71 shown in FIGS. 5A and 5B.

The pivot shaft 73 has a general cylindrical shape that is elongated in the left-right direction. The pivot shaft 73 is rotatably supported by the support part 69.

The contact part 74 has a body part 74A (as an example of a second part), and a protruding part 74B (as an example of a first part).

The body part 74A extends downward from the approximate left-right center of the pivot shaft 73. The body part 74A has a fan-like shape with a central angle of approximately 60 degrees. The body part 74A is positioned leftward of the left inner wall 70L.

The protruding part 74B is disposed on the bottom edge of the body part 74A. The protruding part 74B protrudes rightward from the right surface of the body part 74A and extends along the circumferential direction of the same. The protruding part 74B has a general plate shape that curves along the peripheral edge portion of the body part 74A. The rear end of the protruding part 74B is flush with the rear edge of the body part 74A, while the front end of the protruding part 74B is positioned at the approximate front-rear center of the body part 74A. Hence, the protruding part 74B is provided rearward of a front edge E on the body part 74A. In a vertical projection, the protruding part 74B is disposed rightward (inward) of the support part 69. The protruding part 74B is also exposed through the bottom of the support part 69.

The light-shielding part 75 has a lever part 75A, and a light-shielding plate 75B.

The lever part 75A extends upward from the approximate left-right center of the pivot shaft 73. The lever part 75A has a general plate shape and is positioned leftward of the left inner wall 70L.

The light-shielding plate 75B protrudes leftward from the top edge of the lever part 75A and extends in the front-rear direction. The light-shielding plate 75B has a general plate shape.

The actuator 71 is configured to move among a first position (see FIGS. 5A and 5B) in which the light-shielding part 75 extends upward from the pivot shaft 73, a second position (see FIGS. 6A and 6B) in which the light-shielding part 75 extends diagonally upward and forward from the pivot shaft 73, and a third position (see FIGS. 9A and 9B) in which the light-shielding part 75 extends forward from the pivot shaft 73.

The wire spring 76 is wound about the pivot shaft 73. One end of the wire spring 76 is engaged with the body part 74A, and the other end is engaged with the support part 69 (although this engagement is not illustrated in the drawings). With this configuration, the wire spring 76 constantly urges the actuator 71 toward the first position.

The photosensor 72 is positioned to the front left side of the actuator 71. The right side of the photosensor 72 forms a general U-shape that is open on the right end. The photosensor 72 has a light-emitting part 72A, and a light-receiving part 72B. The light-emitting part 72A is positioned on the lower rear end of the photosensor 72. The light-receiving part 72B is positioned on the upper front end of the photosensor 72. The photosensor 72 transmits an ON signal when the light-receiving part 72B receives light from the light-emitting part 72A.

The CPU 77 is electrically connected to the photosensor 72 and is configured to receive an ON signal from the same. The CPU 77 determines the status of the developer cartridge 9 based on the ON signal received from the photosensor 72. Examples of statuses of the developer cartridge 9 that the CPU 77 can determine may include whether the developer cartridge 9 is mounted in the main casing 2, whether the developer cartridge 9 is a new product (i.e., not used), and the number of pages that the developer cartridge 9 can print.

4. Developer Cartridge Mounting Detection and New Product Detection

As shown in FIGS. 2 and 6B, the contact part 55 of the sensor gear 49 is positioned inside the front end of the opening 63 formed in the cover 43 when the developer cartridge 9 is a new product. The left edge of the contact part 55 is approximately flush with the left surface of the cover 43. At this time, the left-right position of the sensor gear 49 is an example of a first movable position.

As shown in FIG. 3, the gear part 54 of the sensor gear 49 is engaged with the small-diameter gear 48B of the agitator gear 48 on the front side thereof. The portion of the gear part 54 engaged with the small-diameter gear 48B is the downstream end in the counterclockwise rotating direction when viewed from the left side.

The sliding part 56 of the sensor gear 49 is positioned upstream in the counterclockwise rotating direction in a left side view from the sloped surface 39A of the support part 39.

Figure 7:
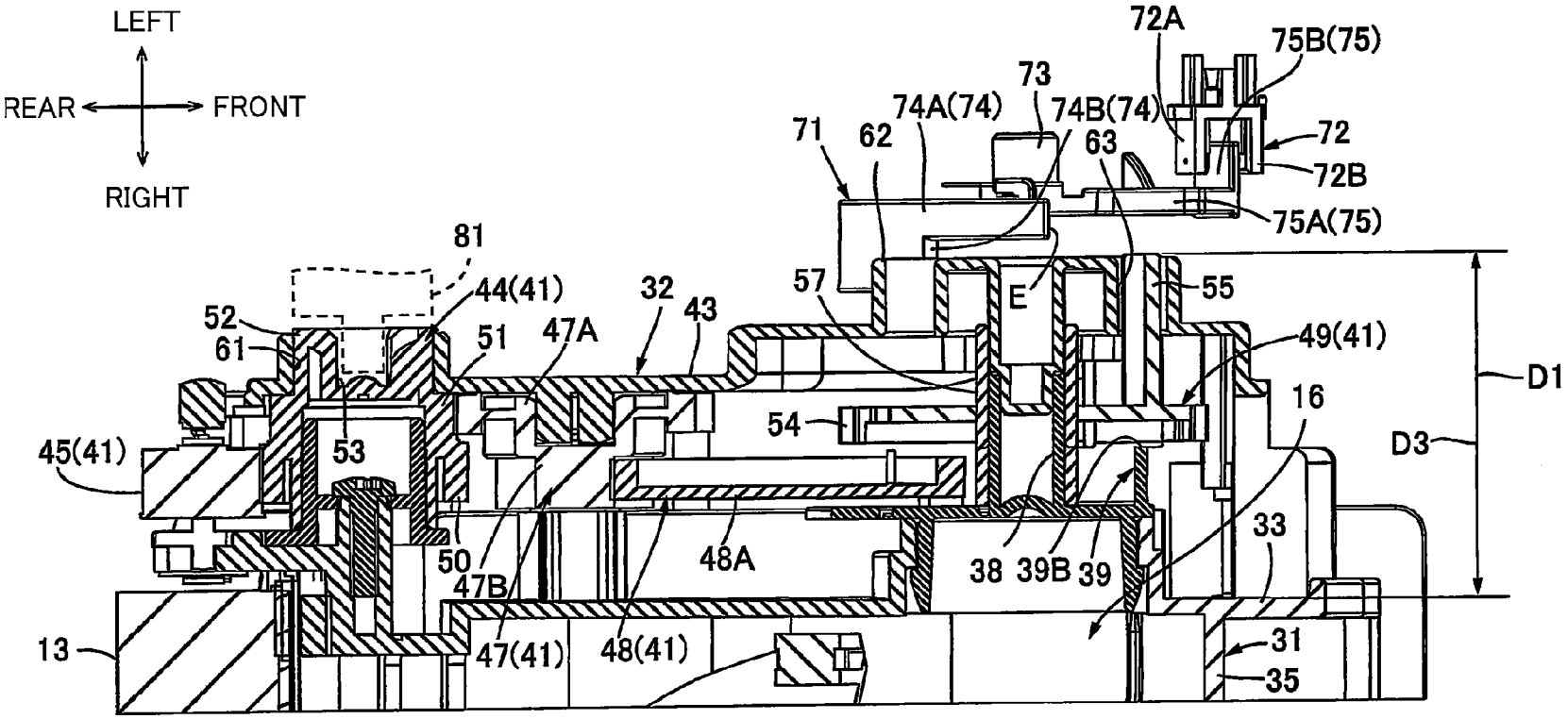
FIG. 7 is a cross-sectional view taken along a line A-A in FIG. 6A.

As shown in FIG. 7, the left-right distance between the left edge of the contact part 55 in this state and the left wall 33 is a distance D1. The distance D1 is an example of a first distance.

As shown in FIGS. 5A and 5B, the actuator 71 is in the first position prior to the developer cartridge 9 being mounted in the main casing 2. At this time, the light-shielding plate 75B of the actuator 71 is separated from the photosensor 72 at a position above and rearward of the same. The light-receiving part 72B receives light emitted from the light-emitting part 72A, and the photosensor 72 transmits an ON signal.

Based on this signal, the CPU 77 determines that the photosensor 72 is on. The CPU 77 determines that the developer cartridge 9 has been removed from the main casing 2 when the photosensor 72 has been on for at least a prescribed time.

When the front cover 7 is opened and the developer cartridge 9 is mounted in the main casing 2, the protruding part 62 of the developer cartridge 9 contacts the protruding part 74B of the actuator 71 from the front side thereof, as shown in FIGS. 6A, 6B, and 8. Through this contact, the actuator 71 is pivoted against the urging force of the wire spring 76 clockwise in a left side view from the first position to the second position. Accordingly, the light-shielding plate 75B of the actuator 71 is moved to a position between the light-emitting part 72A and light-receiving part 72B of the photosensor 72. In this position, the light-shielding plate 75B blocks light emitted by the light-emitting part 72A from reaching the light-receiving part 72B. As a result, the photosensor 72 does not transmit an ON signal, and the CPU 77 determines that the photosensor 72 is off.

When the front cover 7 is subsequently closed, as shown in FIG. 7, a device-side coupling 81 provided in the main casing 2 is fitted into the coupling part 52 of the development coupling 44 so as to be incapable of rotating relative to the coupling part 52. Subsequently, the printer 1 initiates a warm-up operation under control of the CPU 77.

In the warm-up operation, the device-side coupling 81 outputs a drive force from the main casing 2 to the development coupling 44. The development coupling 44 transmits this drive force to the gear part 54 of the sensor gear 49 via the intermediate gear 47 and agitator gear 48. The drive force transmitted to the gear part 54 rotates the sensor gear 49 counterclockwise in a left side view.

Figure 9A:
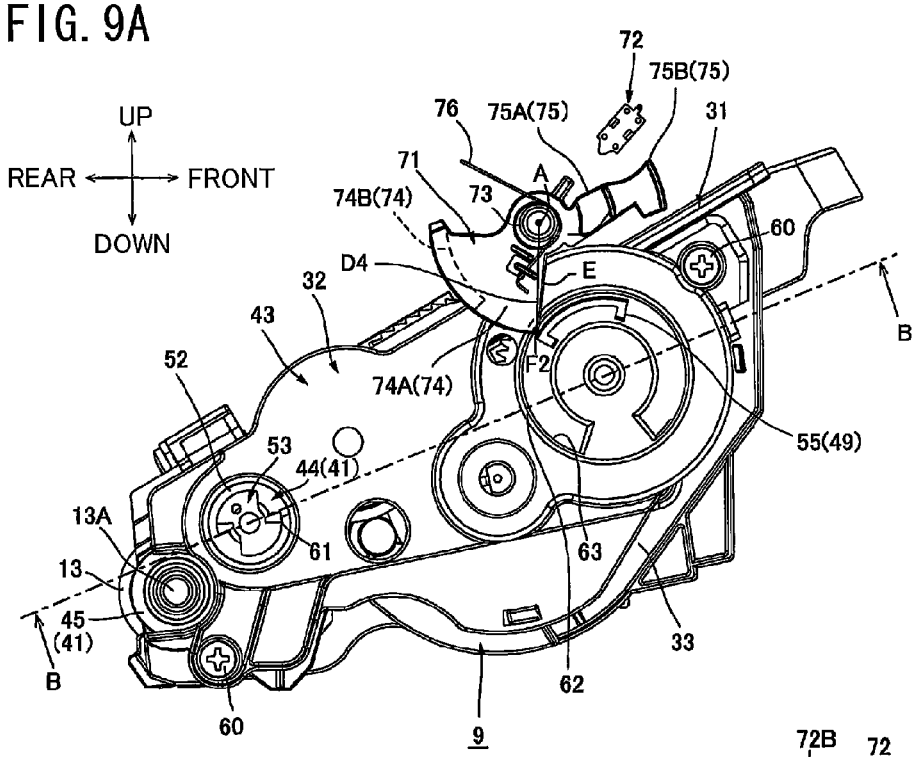
Figure 9B:
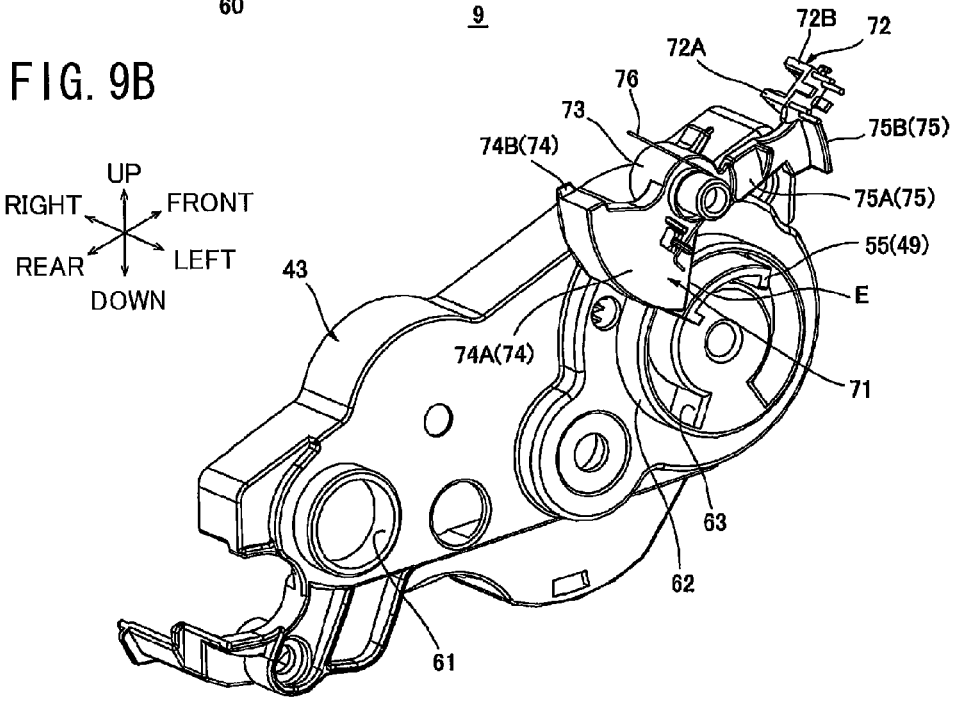

At this time, the sliding part 56 of the sensor gear 49 pivots counterclockwise in a left side view while moving along the sloped surface 39A of the support part 39, as shown in FIGS. 3 and 9B, so that the sensor gear 49 moves gradually leftward. As a consequence, the contact part 55 advances gradually leftward while moving counterclockwise in a left side view until the contact part 55 protrudes leftward from the left edge of the protruding part 62 through the opening 63 formed in the cover 43.

As the sensor gear 49 continues to rotate counterclockwise in a left side view, the sliding part 56 of the sensor gear 49 moves from the sloped surface 39A into the level surface 39B. At this time, the left-right distance between the left edge of the contact part 55 and the left wall 33 is at the maximum distance D2 shown in FIG. 10. The maximum distance D2 between the left edge of the contact part 55 and the left wall 33 is an example of a second distance. The left-right position of the sensor gear 49 at this time is an example of a second movable position.

As the sensor gear 49 continues to rotate counterclockwise in a left side view, the contact part 55 of the sensor gear 49 contacts the front edge E on the body part 74A of the actuator 71 from the front side thereof, as shown in FIGS. 9A and 9B. This contact pivots the actuator 71 against the urging force of the wire spring 76 clockwise in a left side view from the second position to the third position. Consequently, the light-shielding plate 75B of the actuator 71 is moved to a position below and forward of the photosensor 72 so that the light-shielding plate 75B no longer prevents light emitted from the light-emitting part 72A from reaching the light-receiving part 72B. Accordingly, the photosensor 72 transmits an ON signal, whereby the CPU 77 can determine that the photosensor 72 is on.

The actuator 71 is maintained in the third position until the contact part 55 of the sensor gear 49 passes beneath the actuator 71. During this time, the photosensor 72 continues to transmit an ON signal. Here, a distance D4 from a rotational axis A of the actuator 71 to a contact position F2 where the body part 74A of the actuator 71 contacts the contact part 55 of the sensor gear 49 is approximately equivalent to a distance D5 (see FIG. 11) from the rotational axis A of the actuator 71 to a contact position F1 where the protruding part 74B of the actuator 71 contacts the protruding part 62 of the cover 43 when the actuator 71 is in the second position.

Figure 11:
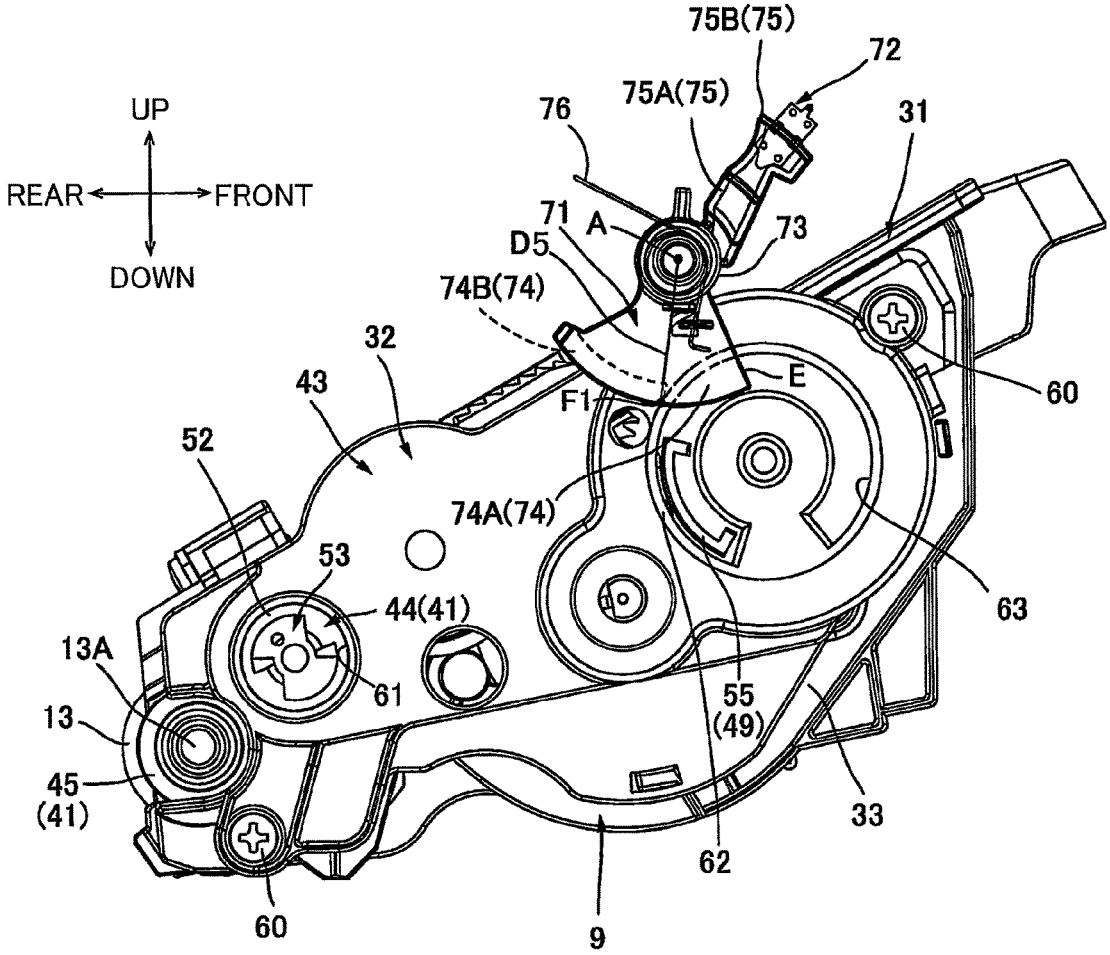
FIG. 11 is a left side view illustrating a pivoting state of the actuator when the sensor gear has completed its rotating operation.

As the sensor gear 49 rotates further counterclockwise in a left side view, the contact part 55 of the sensor gear 49 separates from the actuator 71 and moves below and rearward thereof as shown in FIG. 11. At this time, the urging force of the wire spring 76 pivots the actuator 71 counterclockwise in a left side view until the protruding part 74B contacts the protruding part 62 of the developer cartridge 9 from the rear side. Here, the actuator 71 is in the second position. In this position, the light-shielding plate 75B of the actuator 71 is between the light-emitting part 72A and light-receiving part 72B of the photosensor 72. Accordingly, the light-shielding plate 75B prevents light emitted from the light-emitting part 72A from reaching the light-receiving part 72B. Consequently, the photosensor 72 does not transmit an ON signal and, hence, the CPU 77 determines that the photosensor 72 is off.

Also at this time, the sliding part 56 becomes fitted into the notched part 39C and the sensor gear 49 is moved rightward by the urging force of a spring (not shown). The gear part 54 of the sensor gear 49 becomes disengaged from the small-diameter gear 48B of the agitator gear 48, thereby halting rotation of the sensor gear 49.

In this state, the sensor gear 49 is in the approximate same left-right position as the first movable position described above. This left-right position of the sensor gear 49 is an example of a third movable position. Further, the distance D3 in the left-right direction between the left edge of the contact part 55 and the left wall 33 in this state (see FIG. 7) is an example of a third distance. The distance D3 is equivalent to the distance D1.

Therefore, the CPU 77 determines that the developer cartridge 9 is a new product (unused) when detecting that the photosensor 72 is first off, then on, and then off again after the printer 1 has initiated the warm-up operation. Here, the CPU 77 may determine a correlation between the ON time of the photosensor 72 and data related to the maximum number of pages on which the developer cartridge 9 is capable of forming images. As an example, the CPU 77 may determine that the maximum number of printing pages is 6,000 when the photosensor 72 is on for a long duration, and that the maximum number of printing pages is 3,000 when the photosensor 72 is on for a short duration. Therefore, as described above, the CPU 77 determines that the maximum number of pages on which the developer cartridge 9 can form images is 6,000 when the photosensor 72 is off, then on, then off after the printer 1 initiates a warm-up operation and when the duration of the ON signal is long.

The CPU 77 also determines that the developer cartridge 9 is mounted in the main casing 2 when the photosensor 72 is off for at least a prescribed time.

5. Operational Advantages

With the printer 1 according to the embodiment described above, the actuator 71 is in the second position when the protruding part 62 of the cover 43 contacts the protruding part 74B of the contact part 74, as shown in FIGS. 6A and 6B. At this time, the CPU 77 determines that the developer cartridge 9 is mounted in the main casing 2. Hence, the CPU 77 can reliably determine when the developer cartridge 9 is mounted in the main casing 2 by detecting the position of the cover 43 of the developer cartridge 9 itself.

As shown in FIGS. 9A and 9B, the actuator 71 is moved to the third position when the sensor gear 49 moves and the contact part 55 of the sensor gear 49 contacts the front edge E on the body part 74A of the contact part 74 provided on the actuator 71. At this time, the CPU 77 determines that the developer cartridge 9 is new. Accordingly, the CPU 77 can sense whether the developer cartridge 9 is new according to an operation separate from an operation used for sensing whether the developer cartridge 9 is mounted in the main casing 2. Thus, the CPU 77 can reliably detect both whether the developer cartridge 9 is mounted in the main casing 2 and whether the developer cartridge 9 is a new product.

(2) When the developer cartridge 9 is mounted in the main casing 2, the protruding part 62 of the cover 43 contacts the protruding part 74B of the contact part 74 at a position rearward of the front edge E on the body part 74A, as shown in FIGS. 6A and 6B. With this arrangement, the contact part 55 of the sensor gear 49 can easily contact the body part 74A of the actuator 71 from the front side after the protruding part 62 has contacted the protruding part 74B. As a result, the CPU 77 can reliably detect whether the developer cartridge 9 is a new product, even after detecting that the developer cartridge 9 has been mounted in the main casing 2.

(3) As shown in FIGS. 5A and 5B and 6A and 6B, the protruding part 74B of the actuator 71 is positioned further rightward than the body part 74A. Accordingly, the protruding part 62 of the cover 43 easily contacts the protruding part 74B of the actuator 71 when the developer cartridge 9 is mounted in the main casing 2.

Figure 10:
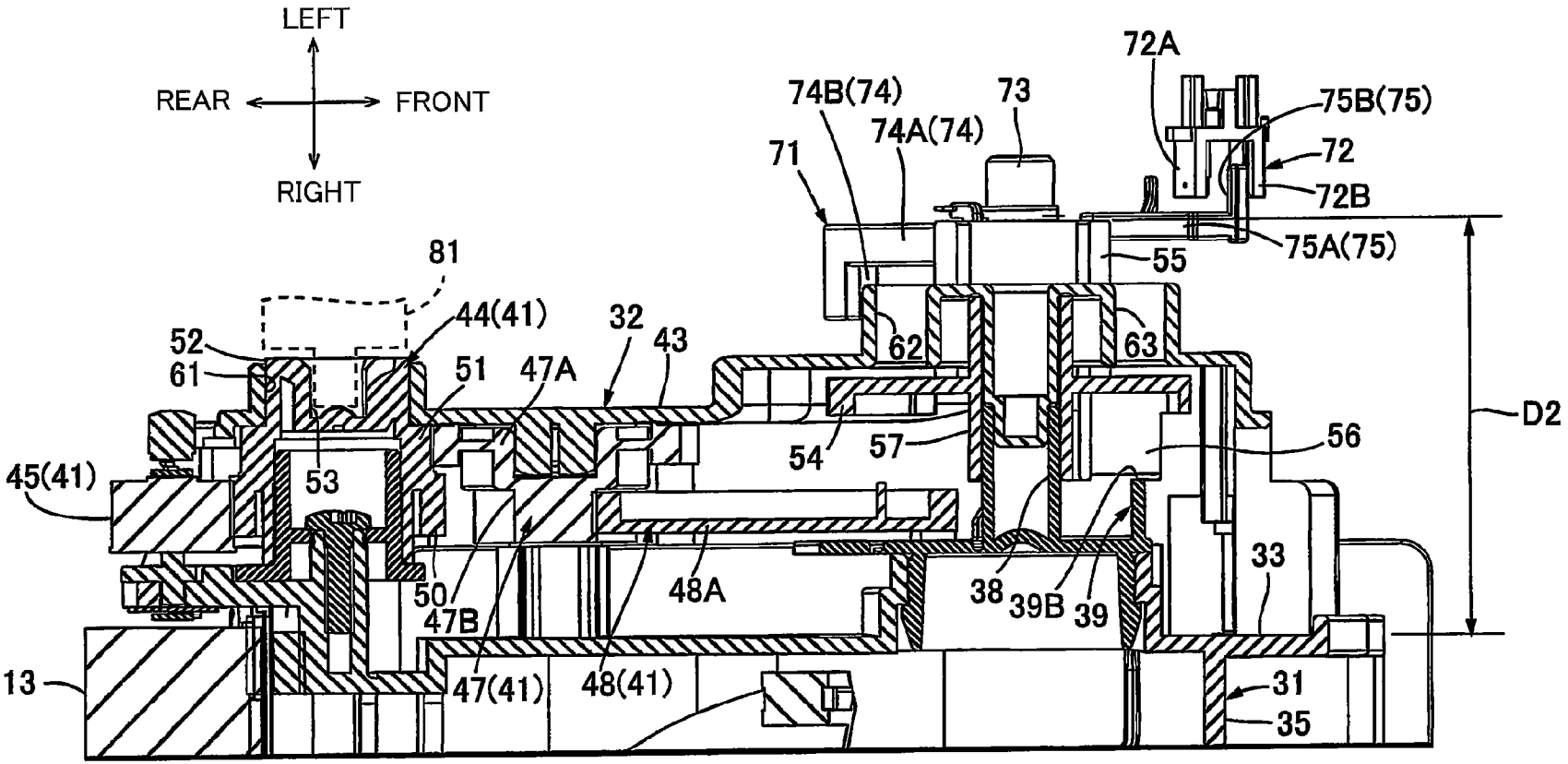
FIG. 10 is a cross-sectional view taken along a line B-B in FIG. 9A.

(4) In the printer 1 according to the embodiment, when the sensor gear 49 is advanced to the second movable position shown in FIG. 10, the sensor gear 49 can be easily detected by the actuator 71. In addition, when the sensor gear 49 is disposed in the first position or is retracted to the third position as shown in FIG. 7, the sensor gear 49 can be prevented from colliding with members in the main casing 2 and from being damaged.

(5) As shown in FIGS. 6A and 6B, the cover 43 for covering the sensor gear 49 can be used to detect whether the developer cartridge 9 has been mounted in the main casing 2.

(6) As shown in FIGS. 6A and 6B, the protruding part 62 of the cover 43 enables the protruding part 74B of the actuator 71 to be easily placed in contact with the cover 43.

(7) As shown in FIGS. 9A and 9B, the contact part 55 of the sensor gear 49 elongated in the left-right direction can be made to contact the body part 74A of the actuator 71. This construction provides the contact part 55 of the sensor gear 49 with sufficient length in the left-right direction for contacting the body part 74A of the actuator 71, ensuring that the contact part 55 reliably contacts the body part 74A.

(8) As shown in FIGS. 6A and 6B, 9A and 9B, and 11, the distance D5 from the rotational axis A of the actuator 71 to the contact position F1 where the protruding part 74B of the actuator 71 contacts the protruding part 62 of the cover 43 when the actuator 71 is in the second position is approximately equal to the distance D4 from the rotational axis A of the actuator 71 to the contact position F2 where the body part 74A of the actuator 71 contacts the contact part 55 of the sensor gear 49 when the actuator 71 is in the third position. Therefore, the distance in which the actuator 71 moves from the first position to the second position can be set approximately equal to the distance in which the actuator 71 moves from the second position to the third position.

6. Second Embodiment

Next, a second embodiment of the developer cartridge 9 will be described with reference to FIGS. 12A through 16, wherein like parts and components are designated with the same reference numerals to avoid duplicating description.

(1) Overview of the Second Embodiment

In the first embodiment described above, the actuator 71 is integrally configured of the body part 74A and protruding part 74B. When the developer cartridge 9 is mounted in the main casing 2, the protruding part 74B contacts the protruding part 62 of the developer cartridge 9, and the body part 74A contacts the contact part 55 of the sensor gear 49.

In the second embodiment, an actuator 91 (as an example of a sensing body and an example of an external detecting device) includes a first sensing body 92 for contacting the protruding part 62 of the developer cartridge 9, and a second sensing body 93 for contacting the contact part 55 of the sensor gear 49. Here, the first sensing body 92 and second sensing body 93 are provided as separate components.

(2) Actuator

In addition to the first sensing body 92 and second sensing body 93, the actuator 91 includes a wire spring 90.

Figure 12A:
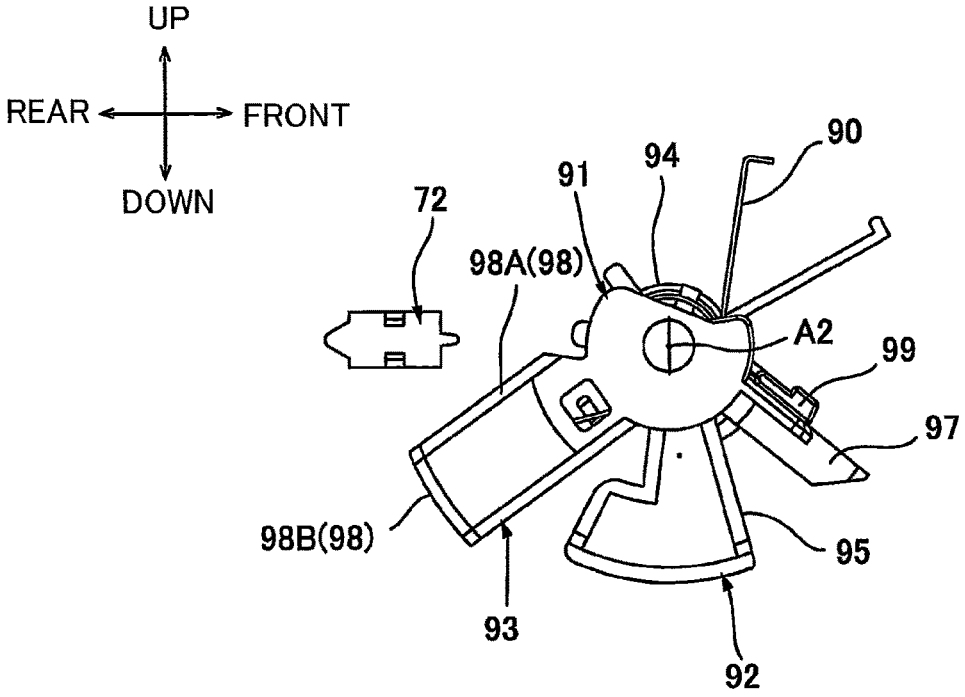
Figure 12B:
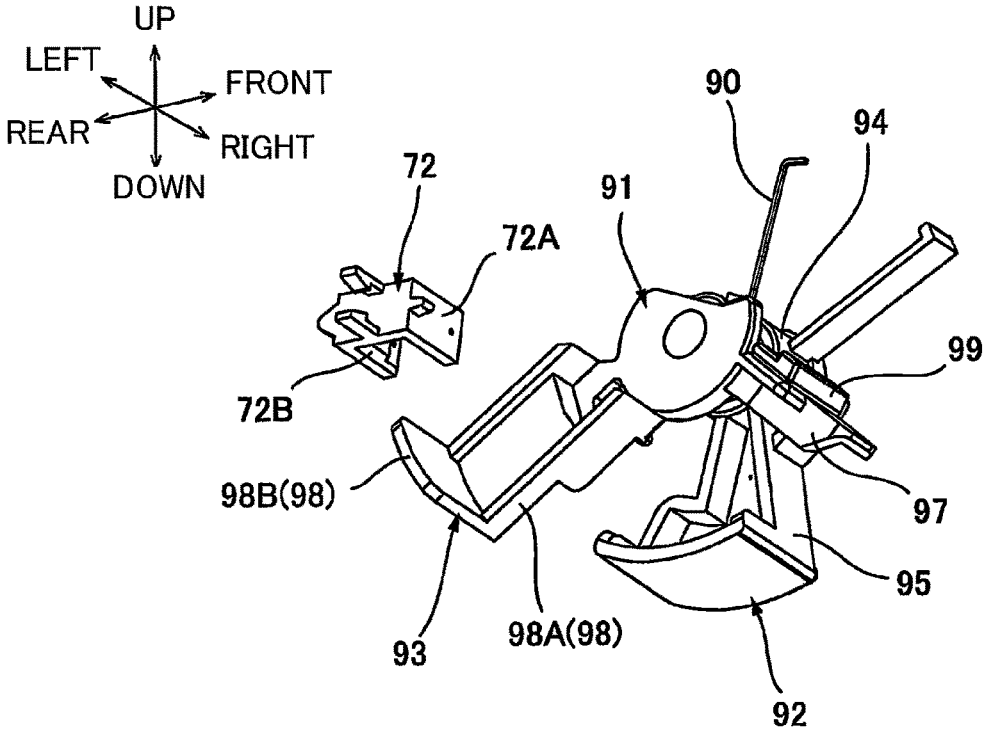

As shown in FIGS. 12A and 12B, the first sensing body 92 includes a first pivot shaft 94, a first contact part 95, and an engaging part 99.

The first pivot shaft 94 has a general cylindrical shape that is elongated in the left-right direction. The first pivot shaft 94 is rotatably supported by the support part 69.

The first contact part 95 extends downward from the right end portion of the first pivot shaft 94. The first contact part 95 has a fan-like shape with a central angle of approximately 45 degrees.

The engaging part 99 is disposed above the first contact part 95. The engaging part 99 extends diagonally downward and forward from the right end portion of the first pivot shaft 94. The engaging part 99 has a general plate shape.

The second sensing body 93 includes a second pivot shaft 96, a second contact part 97, and a light-shielding part 98.

The second pivot shaft 96 has a general columnar shape that is elongated in the left-right direction. The second pivot shaft 96 is rotatably fitted inside the first pivot shaft 94. The second pivot shaft 96 shares a center axis A2 with the first pivot shaft 94.

The second contact part 97 extends diagonally downward and forward from the left end portion of the second pivot shaft 96. The second contact part 97 has a general bar shape and contacts the bottom surface of the engaging part 99.

The light-shielding part 98 has a lever part 98A, and a light-shielding plate 98B.

The lever part 98A extends diagonally downward and rearward from the left end portion of the second pivot shaft 96. The lever part 98A has a general plate shape.

The light-shielding plate 98B protrudes leftward from the lower rear end of the lever part 98A and is elongated vertically. The light-shielding plate 98B has a general plate shape.

The actuator 91 is configured to move among a first position (see FIGS. 12A and 12B) in which the light-shielding part 98 extends diagonally downward and rearward from the second pivot shaft 96, a second position (see FIGS. 13A and 13B) in which the light-shielding part 98 extends rearward from the second pivot shaft 96, and a third position (see FIGS. 14A and 14B) in which the light-shielding part 98 extends diagonally upward and rearward from the second pivot shaft 96.

The wire spring 90 is wound about the second pivot shaft 96. One end of the wire spring 90 is engaged with the light-shielding part 98 of the second sensing body 93, and the other end is engaged with the support part 69 (the engagement is not shown in the drawings). With this configuration, the wire spring 90 constantly urges the actuator 91 counterclockwise in a left side view toward the first position.

(3) Sensor Gear

In place of the contact part 55 described in the first embodiment, the sensor gear 49 according to the second embodiment has a contact part 100. The contact part 100 has two protrusions 100A.

The protrusions 100A are disposed one on the downstream end of the contact part 100 and one on the upstream end with respect to the counterclockwise rotating direction of the contact part 100 in a left side view. The protrusions 100A protrude leftward from the left edge of the contact part 100. The protrusions 100A have a general plate shape.

(4) Developer Cartridge Mounting Detection and New Product Detection

Figure 13A:
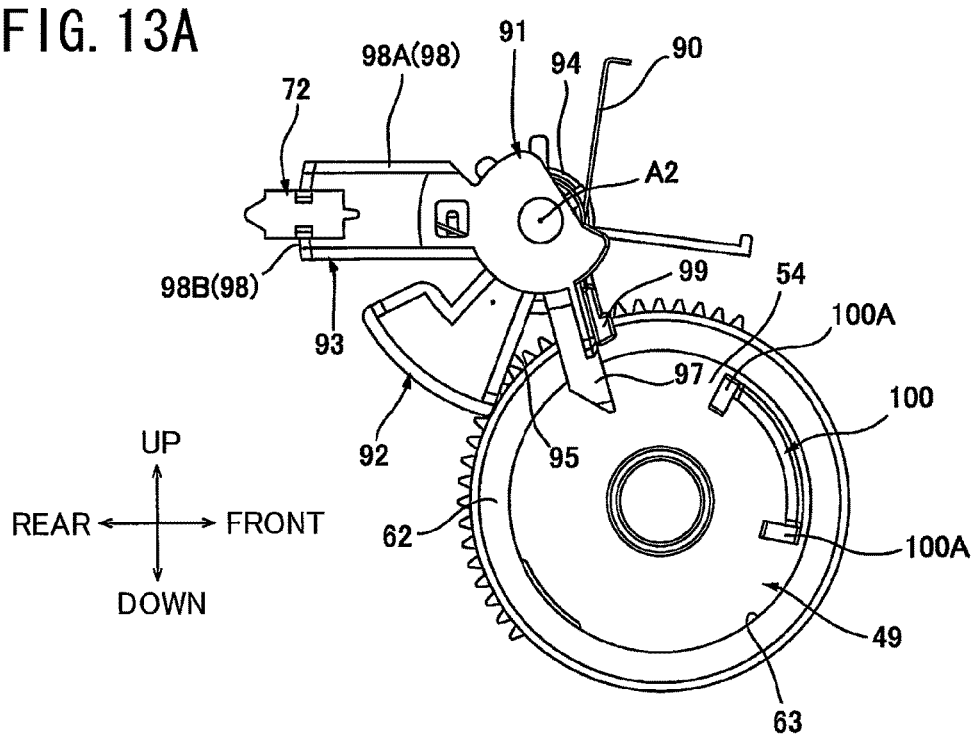
Figure 13B:
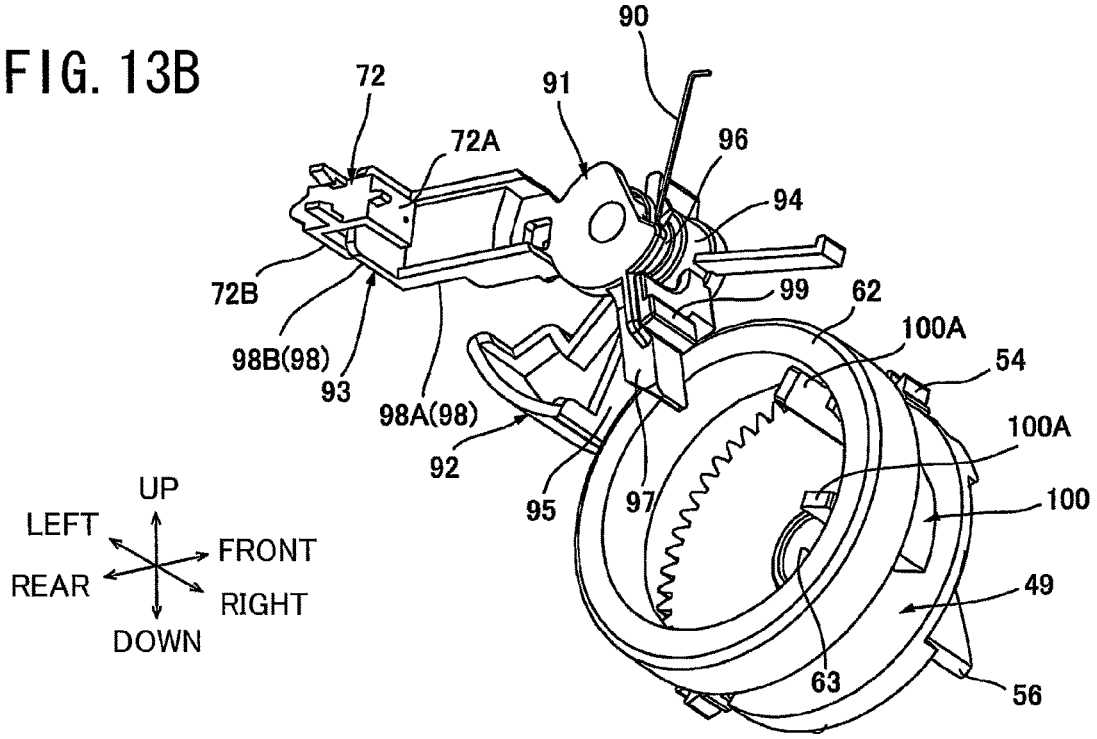

As shown in FIG. 13B, the contact part 100 of the sensor gear 49 is positioned inside the front end of the opening 63 formed in the protruding part 62 when the developer cartridge 9 is a new product. The left edges of the protrusions 100A are approximately flush with the left surface of the protruding part 62. At this time, the left-right position of the sensor gear 49 is an example of a first movable position.

As shown in FIGS. 12A and 12B, the actuator 91 is in the first position prior to the developer cartridge 9 being mounted in the main casing 2. At this time, the light-shielding plate 98B of the actuator 91 is separated from the photosensor 72 at a position below and forward of the same. The light-receiving part 72B receives light emitted from the light-emitting part 72A, and the photosensor 72 transmits an ON signal.

As in the first embodiment described above, the CPU 77 determines that the photosensor 72 is on based on this signal. The CPU 77 determines that the developer cartridge 9 has been removed from the main casing 2 when the photosensor 72 has been on for at least a prescribed time.

When the front cover 7 is opened and the developer cartridge 9 is mounted in the main casing 2, the protruding part 62 of the developer cartridge 9 contacts the first contact part 95 on the first sensing body 92 of the actuator 91 from the front side thereof, as shown in FIGS. 13A and 13B. Through this contact, the first sensing body 92 is pivoted clockwise in a left side view against the urging force of the wire spring 90. At this time, the engaging part 99 of the first sensing body 92 presses against the second contact part 97, causing the second sensing body 93 to pivot clockwise in a left side view together with the first sensing body 92. Through this operation, the actuator 91 is moved to the second position.

Consequently, the light-shielding plate 98B of the actuator 91 is moved to a position between the light-emitting part 72A and light-receiving part 72B of the photosensor 72. In this position, the light-shielding plate 98B blocks light emitted by the light-emitting part 72A from reaching the light-receiving part 72B. As a result, the photosensor 72 does not transmit an ON signal and, hence, the CPU 77 determines that the photosensor 72 is off, as in the first embodiment described above.

When the front cover 7 is subsequently closed, the device-side coupling 81 provided in the main casing 2 is fitted into the coupling part 52 of the development coupling 44 so as to be incapable of rotating relative to the coupling part 52. Subsequently, the printer 1 initiates a warm-up operation under control of the CPU 77.

Figure 14A:
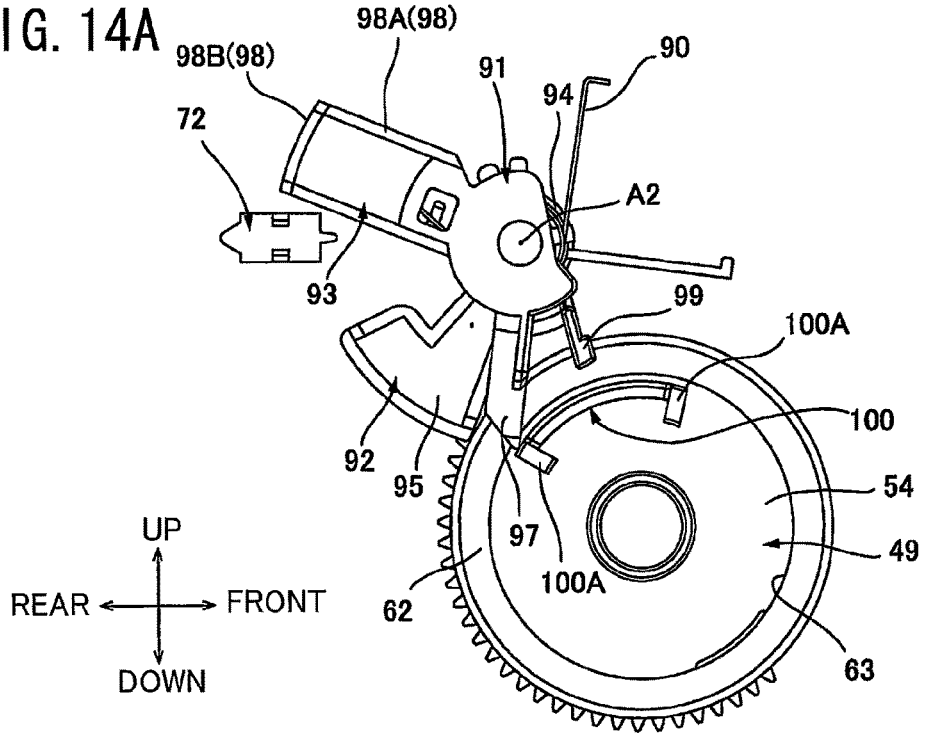
Figure 14B:
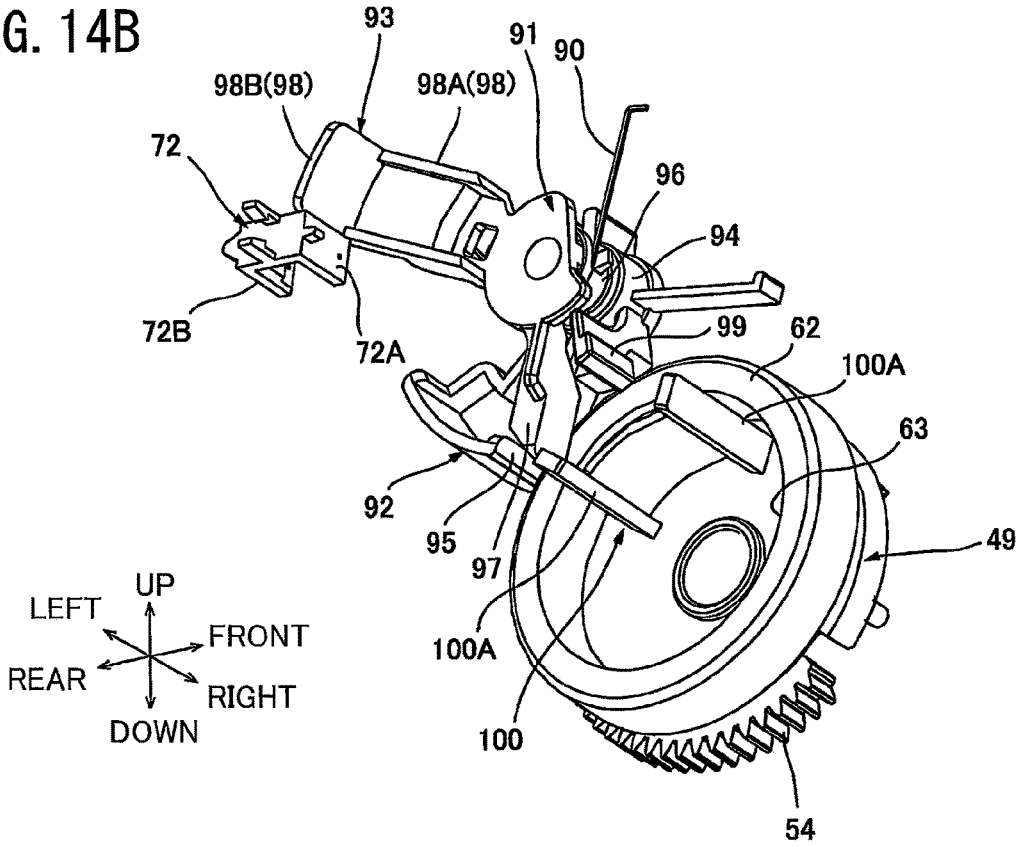

In the warm-up operation, the device-side coupling 81 outputs a drive force from the main casing 2 to the development coupling 44. The development coupling 44 transmits this drive force to the gear part 54 of the sensor gear 49 via the intermediate gear 47 and agitator gear 48. As a result, the sensor gear 49 begins rotating counterclockwise in a left side view while moving gradually leftward, as shown in FIGS. 14A and 14B.

As the sensor gear 49 moves gradually leftward, the protrusions 100A of the contact part 100 advance gradually leftward while rotating counterclockwise in a left side view and begin to protrude leftward from the left edge of the protruding part 62 through the opening 63. In a left side view, the protrusion 100A positioned downstream in the counterclockwise rotating direction contacts the second contact part 97 of the second sensing body 93 from the front side thereof. Accordingly, the second sensing body 93 pivots clockwise in a left side view against the urging force of the wire spring 90. At this time, the second sensing body 93 pivots clockwise in a left side view while the first sensing body 92 does not pivot so that the second contact part 97 separates from the engaging part 99 of the first sensing body 92 rearwardly. Through this operation, the actuator 91 is moved into the third position.

Consequently, the light-shielding plate 98B of the actuator 91 is moved to a position above and forward of the photosensor 72 so that the light-shielding plate 98B no longer prevents light emitted from the light-emitting part 72A from reaching the light-receiving part 72B. Accordingly, the photosensor 72 transmits an ON signal, whereby the CPU 77 can determine that the photosensor 72 is on, as in the first embodiment described above.

Figure 15:
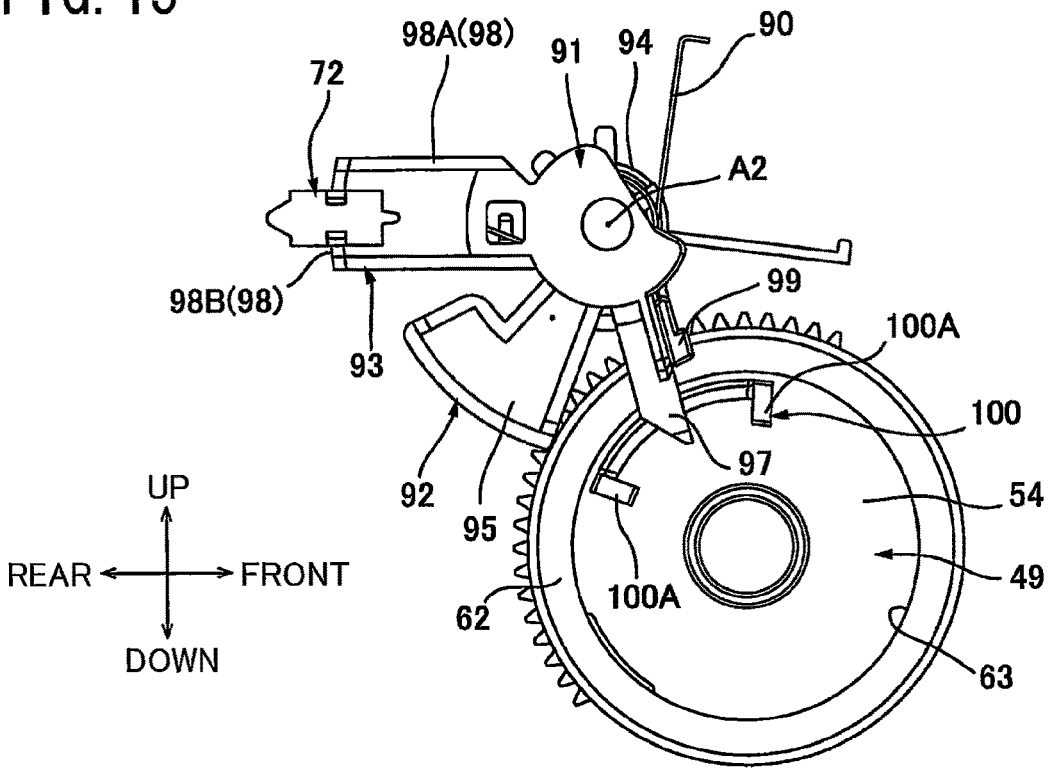
FIG. 15 illustrates a pivoting state of the actuator according to the second embodiment when the protrusion of the sensor gear disposed on the rear side has separated from the second sensing body of the actuator.

As the sensor gear 49 rotates further counterclockwise in a left side view, the protrusion 100A on the downstream side of the counterclockwise rotating direction separates from the second sensing body 93 by moving downward and rearward from the same, as shown in FIG. 15. At this time, the urging force of the wire spring 90 pivots the second sensing body 93 counterclockwise in a left side view until the second contact part 97 contacts the engaging part 99 of the first sensing body 92 from the rear side thereof. This contact moves the actuator 91 into the second position.

In this position, the light-shielding plate 98B of the actuator 91 is between the light-emitting part 72A and light-receiving part 72B of the photosensor 72. Accordingly, the light-receiving part 72B prevents light emitted from the light-emitting part 72A from reaching the light-receiving part 72B. Consequently, the photosensor 72 does not transmit an ON signal and, hence, the CPU 77 determines that the photosensor 72 is off.

Figure 16:
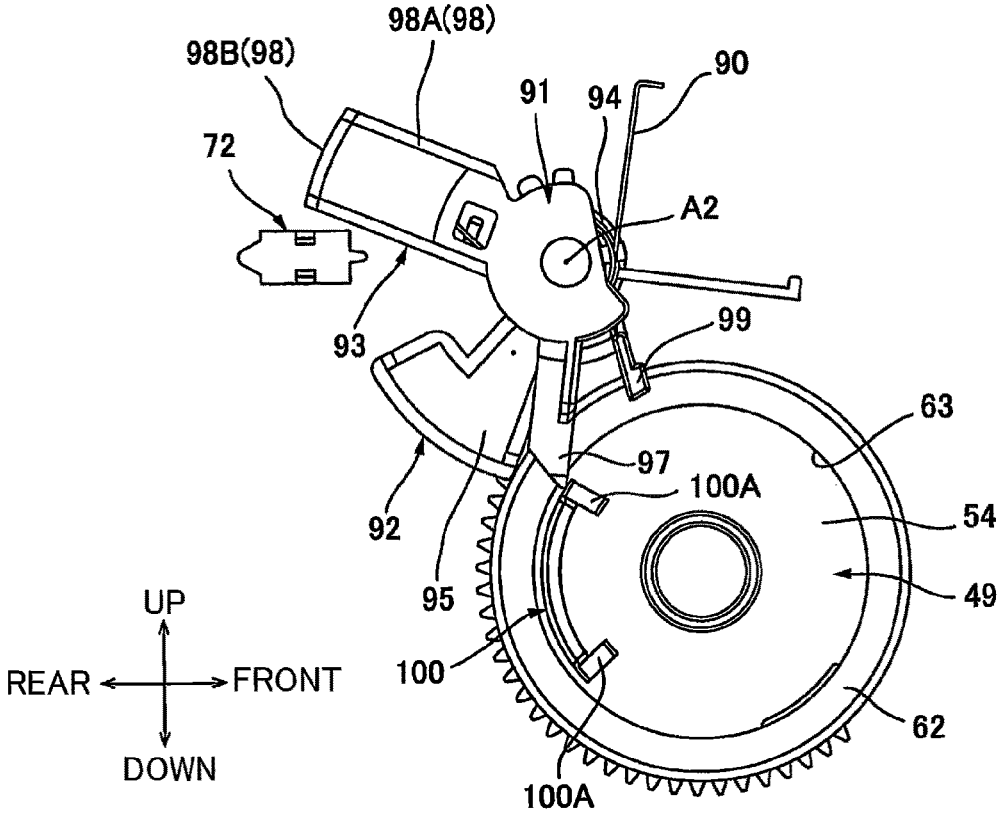
FIG. 16 illustrates a pivoting state of the actuator according to the second embodiment when a protrusion of the sensor gear that is disposed on a front side contacts the second sensing body of the actuator.

As the sensor gear 49 continues to rotate counterclockwise in a left side view, the protrusion 100A on the upstream side of the contact part 100 in the counterclockwise rotating direction contacts the second contact part 97 of the second sensing body 93 from the front side thereof, as shown in FIG. 16, similar to the protrusion 100A on the downstream side described earlier. Consequently, the second sensing body 93 pivots clockwise in a left side view against the urging force of the wire spring 90, moving the actuator 91 into the third position. As a result, the photosensor 72 transmits an ON signal and, hence, the CPU 77 determines that the photosensor 72 is on.

When the sensor gear 49 rotates further in the counterclockwise direction in a left side view, the protrusion 100A on the upstream side in the rotating direction separates from the second sensing body 93 and moves downward and rearward therefrom. Consequently, the actuator 91 is moved to the second position, the photosensor 72 no longer transmits an ON signal, and the CPU 77 determines that the photosensor 72 is off.

Therefore, the CPU 77 determines that the developer cartridge 9 is a new product when detecting that the photosensor 72 is first off, then on, and then off again after the printer 1 has initiated the warm-up operation. Here, the CPU 77 may determine a correlation between the number of times that the photosensor 72 is turned on and data related to the maximum number of pages on which the developer cartridge 9 is capable of forming images. As an example, the CPU 77 may determine that the maximum number of printing pages is 6,000 when the photosensor 72 is found to be on two times, and that the maximum number of printing pages is 3,000 when the photosensor 72 is found to be on only one time.

Therefore, as described above, the CPU 77 determines that the maximum number of pages on which the developer cartridge 9 can form images is 6,000 when the photosensor 72 is off, then on, then off, then on, and then off after the CPU 77 initiates a warm-up operation.

(5) Operational Advantages of the Second Embodiment (5-1) With the printer 1 according to the second embodiment described above, when the actuator 91 is moved from the second position to the third position, the second sensing body 93 moves, but the first sensing body 92 does not move, as illustrated in FIGS. 13A and 13B and 14A and 14B. Thus, the structure according to the second embodiment can reliably move the second sensing body 93 alone when the actuator 91 is moved from the second position to the third position.

(5-2) With the printer 1 according to the second embodiment, both the first sensing body 92 and the second sensing body 93 pivot around the center axis A2. By providing a common center axis A2 for pivoting the first sensing body 92 and second sensing body 93, the arrangement of the first sensing body 92 and second sensing body 93 can be made more efficient.

(5-3) The printer 1 according to the second embodiment can obtain the same operational advantages in the first embodiment described above.

(6) Variation of the Second Embodiment

Figure 17:
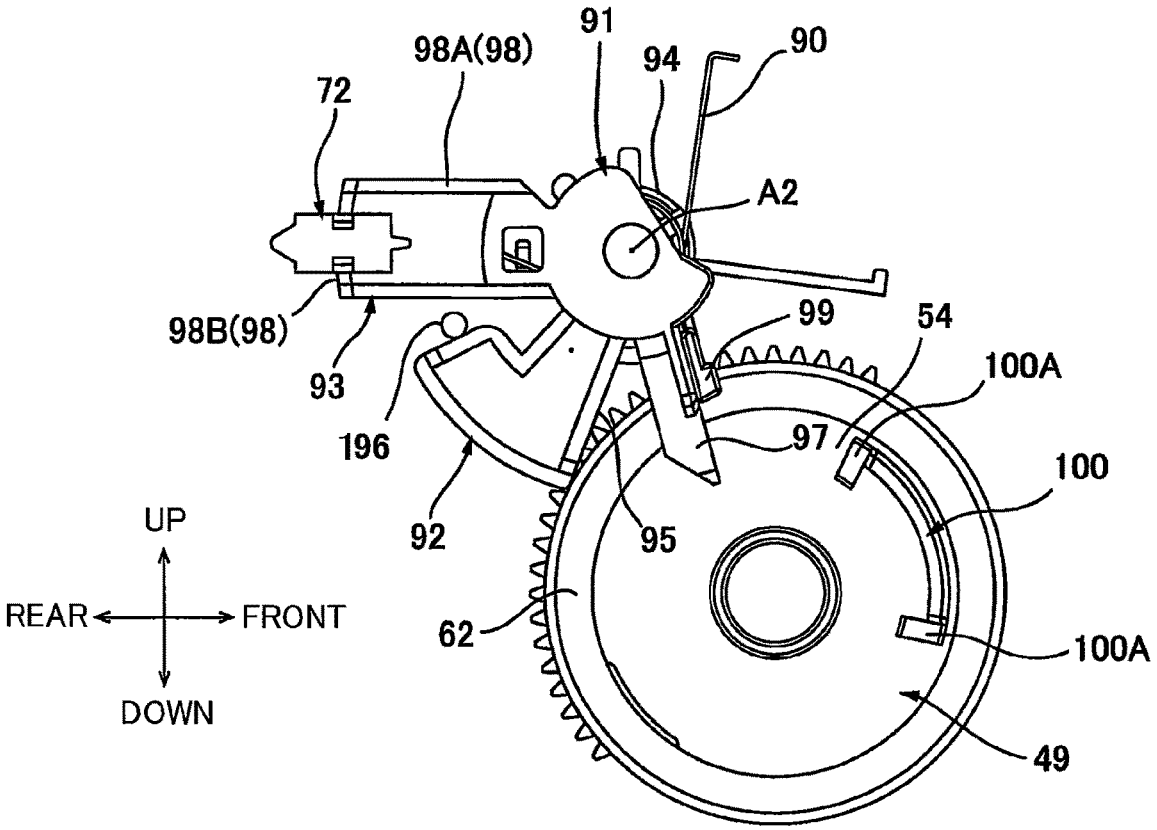
FIG. 17 illustrates a modification of the second embodiment.

The main casing 2 of the printer 1 in the second embodiment may also be provided with a protrusion 196, as shown in FIG. 17. The protrusion 196 has a general columnar shape and protrudes rightward from the inner left surface of the main casing 2. The protrusion 196 is disposed at a position above and rearward of the first sensing body 92, i.e., on the downstream side of the first sensing body 92 with respect to the direction that the first sensing body 92 moves from the first position to the second position. The protrusion 196 is in contact with the rear end of the first contact part 95 when the first sensing body 92 is in the second position.

In this variation of the second embodiment, the protrusion 196 restricts the first sensing body 92 from pivoting further downstream in the clockwise direction in a left side view. By preventing such further movement of the first sensing body 92, the protrusion 196 can prevent the first sensing body 92 from accidentally moving from the second position to the third position due to contact with a reset gear or the like, thereby preventing the printer 1 from incorrectly detecting the new/used state of the developer cartridge 9.

7. Other Variations of the Embodiments (1) The sensor gear 49 is used as an example of the movable member in the embodiments described above. However, there is no particular restriction on the configuration of the movable member. For example, the movable member may have a rack and pinion configuration. Alternatively, the gear teeth of the sensor gear 49 may be replaced with a material that produces friction, such as rubber.

(2) The developer cartridge 9 having a developing roller 13 is used as an example of a cartridge in the embodiments described above. However, the cartridge may be a toner box type cartridge that does not possess a developing roller therein, or a process cartridge that is integrally provided with a drum cartridge and a developer cartridge.

(3) In the embodiments described above, a drive force is inputted into the developer cartridge 9 by coupling the development coupling 44 with the device-side coupling 81. However, the configuration for inputting a drive force from the main casing 2 to the developer cartridge 9 is not limited to this configuration. For example, a prescribed gear may be provided for inputting a drive force into the developer cartridge 9.

(4) In the embodiments described above, the photosensitive drum 10 is exposed by the scanning unit 4, but an LED or the like may be used instead of the scanning unit 4.

While the invention has been described in detail with reference to the embodiments and variations thereof, it would be apparent to those skilled in the art that various changes and modifications may be made therein without departing from the spirit of the invention.

What is claimed is:

1. A developer cartridge comprising:

a developing roller configured to rotate about a rotational axis;

a coupling member configured to rotate about an axis upon receipt of a drive force from an outside of the developer cartridge, the axis extending along the rotational axis;

a housing provided with a first protruding part that extends in an axial direction, along which the rotational axis of the developing roller extends, the first protruding part being configured such that when the developer cartridge is mounted in an apparatus body of an image forming apparatus, the first protruding part contacts a sensing body provided in the apparatus body of the image forming apparatus, the sensing body being configured such that when the first protruding part contacts the sensing body, the sensing body rotates from a first sensing-body position to a second sensing-body position; and a detection gear configured to rotate about a first axis in response to rotation of the coupling member, the first axis extending along the rotational axis, the detection gear being provided with a second protruding part that extends in the axial direction, the second protruding part being configured such that in a state where the developer cartridge is mounted in the apparatus body of the image forming apparatus, when the detection gear rotates, the second protruding part contacts the sensing body disposed at the second sensing-body position, wherein in the state where the developer cartridge is mounted in the apparatus body of the image forming apparatus, a distance defined in the axial direction between the housing and a portion of the sensing body that contacts the second protruding part is greater than another distance defined in the axial direction between the housing and another portion of the sensing body that contacts the first protruding part.

2. The developer cartridge according to claim 1, wherein the first protruding part is out of contact with the sensing body when the second protruding part is in contact with the sensing body.

3. The developer cartridge according to claim 1, further comprising a cover configured to cover at least part of the detection gear, the cover having the first protruding part.

4. The developer cartridge according to claim 3, wherein the first protruding part is in a circular cylindrical shape extending about the first axis.

5. The developer cartridge according to claim 1, wherein the housing is configured to accommodate developer therein, and wherein the detection gear is configured to move from a first position to a second position, a first distance and a second distance being defined in the axial direction, the first distance being defined as a distance between the housing and the second protruding part disposed in the first position, the second distance being defined as a distance between the housing and the second protruding part disposed in the second position, the second distance being greater than the first distance.

6. The developer cartridge according to claim 5, wherein the housing is provided with a cam configured to move the detection gear from the first position to the second position.

7. The developer cartridge according to claim 1, wherein a distance defined in a perpendicular direction perpendicular to the axial direction between the coupling member and the first protruding part is smaller than a distance defined in the perpendicular direction between the coupling member and the second protruding part.

8. An image forming apparatus comprising:

an apparatus body;

a sensing body provided in the apparatus body, the sensing body having a first contact portion and a second contact portion, the sensing body being configured to rotate from a first sensing-body position to a second sensing-body position; and a developing cartridge configured to be mounted in the apparatus body, the developing cartridge including:

a developing roller configured to rotate about a rotational axis;

a coupling member configured to rotate about an axis upon receipt of drive force from the apparatus body, the axis extending along the rotational axis;

a cartridge housing provided with a first protruding part that extends in an axial direction, along which the rotational axis of the developing roller extends; and a detection gear configured to rotate about a first axis in response to rotation of the coupling member, the first axis extending along the rotational axis, the detection gear having a second protruding part extending along the axial direction, wherein the first protruding part of the developing cartridge is configured such that when the developing cartridge is mounted in the apparatus body, the first protruding part contacts the first contact portion of the sensing body, wherein the sensing body is configured to rotate from the first sensing-body position to the second sensing-body position when the first protruding part contacts the first contact portion, wherein the second protruding part of the developing cartridge is configured such that in a state where the developing cartridge is mounted in the apparatus body, when the detection gear rotates, the second protruding part contacts the second contact portion of the sensing body disposed at the second sensing-body position, and wherein in the state where the developing cartridge is mounted in the apparatus body, a distance defined in the axial direction between the cartridge housing and the second contact portion is greater than a distance defined in the axial direction between the cartridge housing and the first contact portion.

9. The image forming apparatus according to claim 8, wherein the first protruding part is out of contact with the sensing body when the second protruding part is in contact with the sensing body.

10. The image forming apparatus according to claim 8, wherein the developing cartridge further includes a cover configured to cover at least part of the detection gear, the cover having the first protruding part.

11. The image forming apparatus according to claim 10, wherein the first protruding part is in a circular cylindrical shape extending about the rotational axis.

12. The image forming apparatus according to claim 8, wherein a distance defined in a perpendicular direction perpendicular to the axis direction between the coupling member and the first protruding part is smaller than a distance defined in the perpendicular direction between the coupling member and the second protruding part.

13. The image forming apparatus according to claim 8, wherein a distance defined in a perpendicular direction perpendicular to the axis direction between the coupling member and the first protruding part is smaller than a distance defined in the perpendicular direction between the coupling member and the first axis.

* * * * *